US009551947B2

(12) United States Patent
Hiroko et al.

(10) Patent No.: US 9,551,947 B2
(45) Date of Patent: Jan. 24, 2017

(54) TONER

(75) Inventors: Shuichi Hiroko, Susono (JP); Yoshihiro Nakagawa, Numazu (JP); Tomohisa Sano, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 50 days.

(21) Appl. No.: 13/205,599

(22) Filed: Aug. 8, 2011

(65) Prior Publication Data

US 2012/0045717 A1 Feb. 23, 2012

(30) Foreign Application Priority Data

Aug. 23, 2010 (JP) ..... 2010-186296

(51) Int. Cl.
*G03G 9/083* (2006.01)
*G03G 9/08* (2006.01)
*G03G 9/087* (2006.01)

(52) U.S. Cl.
CPC ..... *G03G 9/0836* (2013.01); *G03G 9/0804* (2013.01); *G03G 9/0806* (2013.01); *G03G 9/0834* (2013.01); *G03G 9/0837* (2013.01); *G03G 9/0839* (2013.01); *G03G 9/08795* (2013.01); *G03G 9/08797* (2013.01)

(58) Field of Classification Search
CPC .. G03G 9/0834; G03G 9/0836; G03G 9/0833; G03G 9/0835; G03G 9/0802; G03G 9/0804
USPC ..... 430/106.1, 106.6, 109.1
See application file for complete search history.

(56) References Cited

U.S. PATENT DOCUMENTS 5,744,276 A 4/1998 Ohno et al.
5,942,366 A 8/1999 Ohno et al.
6,017,669 A * 1/2000 Unno et al. ..... 430/108.1
6,251,555 B1 * 6/2001 Hayashi et al. ..... 430/106.2
6,569,589 B2 5/2003 Inaba et al.
7,123,862 B2 10/2006 Hasegawa et al.
7,371,494 B2 5/2008 Chiba et al.
(Continued)

FOREIGN PATENT DOCUMENTS

EP 0764889 B1 * 9/1996 ..... G03G 9/087
JP 7-92737 A 4/1995
(Continued)

OTHER PUBLICATIONS

Japanese Office Action dated Apr. 28, 2015 in Japanese Application No. 2011-172996.

*Primary Examiner* — Peter Vajda
*Assistant Examiner* — Olatunji Godo
(74) *Attorney, Agent, or Firm* — Fitzpatrick, Cella, Harper & Scinto

(57) ABSTRACT

A magnetic toner is provided that exhibits an excellent dot reproducibility and developing performance after being allowed to stand in a high temperature and high humidity environment and an excellent low-temperature fixability. The magnetic toner has an inorganic fine powder and a magnetic toner particle containing a binder resin, a magnetic body, and a release agent, wherein in a stress relaxation measurement using a rotating plate rheometer, the magnetic toner exhibits a yield value A at 25° C. of at least $3\times10^6$ (sec), and the magnetic toner that has been heated to 80° C. and then cooled to 25° C. exhibits a yield value B at 25° C. of not more than $1\times10^5$ (sec).

5 Claims, 1 Drawing Sheet

(56) References Cited

U.S. PATENT DOCUMENTS

| | | | | |
|---|---|---|---|---|
| 7,537,877 | B2 | 5/2009 | Yoshiba et al. | |
| 7,582,401 | B2 | 9/2009 | Ogawa et al. | |
| 7,638,251 | B2 | 12/2009 | Yamazaki et al. | |
| 7,678,523 | B2 | 3/2010 | Hiroko et al. | |
| 7,678,524 | B2 | 3/2010 | Hasegawa et al. | |
| 7,897,316 | B2 | 3/2011 | Yamazaki et al. | |
| 7,923,190 | B2 | 4/2011 | Magome et al. | |
| 7,935,467 | B2 | 5/2011 | Dojo et al. | |
| 8,026,030 | B2 | 9/2011 | Moribe et al. | |
| 2009/0047043 | A1 | 2/2009 | Dojo et al. | |
| 2009/0092919 | A1* | 4/2009 | Hiroko et al. | 430/110.1 |
| 2009/0117477 | A1 | 5/2009 | Magome et al. | |
| 2009/0197192 | A1* | 8/2009 | Hiroko et al. | 430/106.2 |
| 2010/0266943 | A1 | 10/2010 | Sano et al. | |
| 2011/0294056 | A1 | 12/2011 | Magome et al. | |
| 2011/0311910 | A1 | 12/2011 | Matsui et al. | |

FOREIGN PATENT DOCUMENTS

| | | | |
|---|---|---|---|
| JP | 2004-177866 | A | 6/2004 |
| JP | 2005-107520 | A | 4/2005 |
| JP | 2005-263619 | A | 9/2005 |
| JP | 2006-195034 | A | 7/2006 |
| JP | 2009-109827 | A | 5/2009 |
| WO | 2009/057807 | A1 | 5/2009 |

* cited by examiner

TONER

BACKGROUND OF THE INVENTION

Field of the Invention

The present invention relates to a toner for use in recording methods that use electrophotography, electrostatic recording, electrostatic printing, or toner jet recording.

Description of the Related Art

Copiers and printers have in recent years entered into use in new market sectors, and a high image stability and increases in printing speed are thus being required even for use under diverse environments. For example, printers, which previously have been used mainly in offices, are now also being used under severe environments of high temperature and high humidity. At the same time, additional savings in energy and space are also being required, and it has thus become critical to provide a stable image quality even under these conditions.

Various image-forming methods have been proposed as a consequence. Among these is the so-called jumping method, which uses a magnetic toner and a rotating sleeve having a magnet pole disposed at its center and which uses an electric field to induce jumping between the surface of the photosensitive member and the surface of the sleeve. The jumping method is a developing method that has a high stability and is an effective means for responding to the above-described needs.

However, during, for example, storage in a warehouse, long-term standing may occur under conditions that are more severe than normal, and this can easily cause a deterioration in toner properties. A toner that has experienced such a history is prone to exhibit, for example, an impaired image quality and an impaired durability.

In particular, the decline in the uniformity of charging brought about by toner deterioration results in inaccurate jumping by the toner to the latent image on the photosensitive member, which can produce the problem of causing a decline in the dot reproducibility due to, for example, scattering into areas outside the latent image on the photosensitive member. The phenomenon of this type in particular becomes very prominent under high temperatures/high humidities, which readily produce charge leakage due to the binding of moisture to the toner.

High temperatures/high humidities are also particularly problematic for toner durability. For example, exudation of the release agent (also referred to below as wax) present in the toner is prone to occur. In addition, an acceleration of the deterioration in the durability is prone occur, for example, the external additives on the toner surface are buried.

In order to inhibit toner deterioration in such severe environments, an increase in the hardness can be contemplated in order to raise the heat resistance of the toner; however, raising the hardness alone produces an impaired fixing performance and makes it difficult to balance the developing performance and the fixing performance.

In response to the various problems described above, an example is presented in Japanese Patent Application Laid-open No. H7-092737 (U.S. Pat. Nos. 5,744,276 and 5,942,366) in which the low-temperature fixability and dot reproducibility are stabilized by controlling the molecular weight distribution and viscoelasticity of the toner; however, there is still room for improvement here with regard to further increasing the image stability and durability after standing at high temperature/high humidity.

In addition, an improvement in the fixing performance, e.g., the hot offset and so forth, is pursued in Japanese Patent Application Laid-open No. 2004-177866 by controlling the relaxation modulus during a prescribed stress relaxation and controlling the stress relaxation time at the fixing unit. Again, however, there is still room for improvement here with regard to increasing the image stability and durability after standing at high temperature/high humidity.

An improved low-temperature fixability and an inhibition of image defects are pursued in WO 2009/057807 (US Published Application No. 2009/0197192) by controlling the dispersibility of the magnetic body in a magnetic toner. Again, however, there is still room for improvement here with regard to increasing the image stability and durability after standing at high temperature/high humidity.

SUMMARY OF THE INVENTION

The present invention was pursued in view of the above-described problems with the prior art and has as an object the introduction of a magnetic toner that in particular exhibits an excellent low-temperature fixability and an excellent dot reproducibility and developing performance after standing under a high temperature/high humidity environment.

As a result of intensive investigations directed to solving the above-described problems, the present inventors discovered that these problems can be solved by the magnetic toner described herebelow and thereby achieved the present invention. Thus, the features of the present invention are as follows.

A magnetic toner containing an inorganic fine powder and a magnetic toner particle containing a binder resin, a magnetic body, and a release agent, wherein in a stress relaxation measurement using a rotating plate rheometer, the magnetic toner has a yield value A at 25° C. of at least $3\times10^6$ (sec) and the magnetic toner that has been heated to 80° C. and then cooled to 25° C. has a yield value B at 25° C. of not more than $1\times10^5$ (sec).

The present invention can provide a magnetic toner that exhibits an excellent low-temperature fixability and an excellent dot reproducibility and developing performance after standing in a high temperature/high humidity environment.

Further features of the present invention will become apparent from the following description of exemplary embodiments with reference to the attached drawings.

DESCRIPTION OF THE EMBODIMENTS

Figure 1:
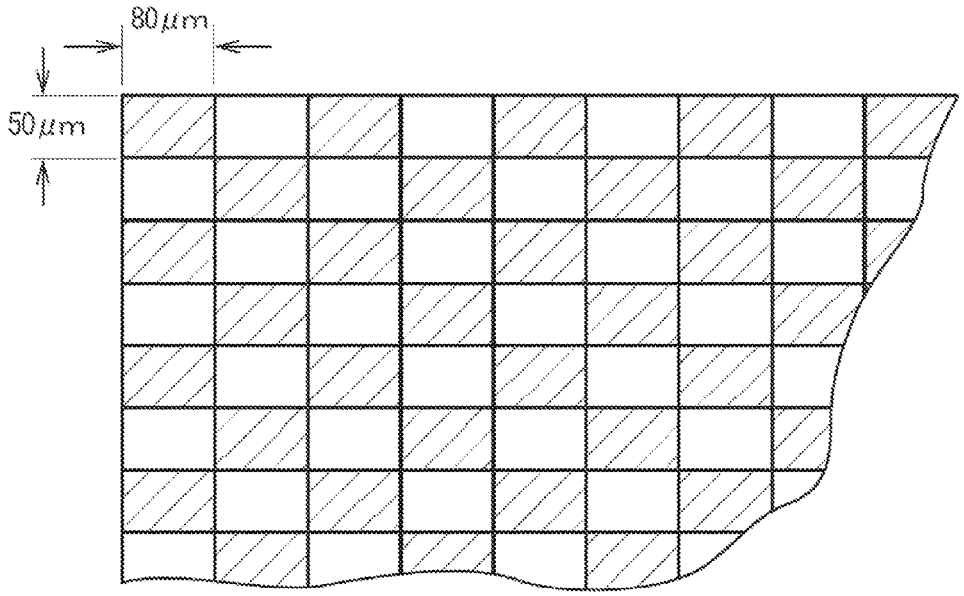
FIG. 1 is a drawing that describes the pattern for evaluating the dot reproducibility.

The magnetic toner of the present invention (hereafter also referred to simply as toner) is a magnetic toner that has an inorganic fine powder and a magnetic toner particle containing a binder resin, a magnetic body, and a release agent, wherein in a stress relaxation measurement using a rotating plate rheometer, this magnetic toner exhibits a yield value A at 25° C. of at least $3\times10^6$ (sec), and the magnetic toner that has been heated to 80° C. and then cooled to 25° C. exhibits a yield value B at 25° C. of not more than $1\times10^5$ (sec). By adopting this structure, the environmental stability of the toner is raised and the dot reproducibility and developing performance after standing under high temperature/ high humidity is significantly improved and in combination with this the low-temperature fixability can be improved.

As noted above, in order in particular to achieve a balance between the low-temperature fixability and an improved dot reproducibility after passage through a change in the environment to a high temperature/high humidity environment, resistance by the toner to deterioration when the environment changes and during large-volume image formation and control of the toner structure to make possible an acceleration of toner softening by heating during fixing are critical.

As a result of intensive investigations, the present inventors discovered that the low-temperature fixability can be balanced with the dot reproducibility and developing performance after standing in a high temperature/high humidity environment by controlling the toner structure in order in stress relaxation measurements on the toner to control the yield value A at 25° C. and the yield value B at 25° C. after heating to 80° C. into respective prescribed ranges.

The above-described stress relaxation is a phenomenon in which, when a material is allowed to stand under the application of a constant strain, the stress accompanying this declines with elapsed time. The yield value is the point at which, in response to a constant strain, the stress undergoes a sharp change and in the present invention represents an inflection point in the stress relaxation curve in the stress relaxation measurements described below.

These generally are physical properties of the particles that constitute the sample and represent a combined value from particles that are strongly resistant to the externally applied strain and particles that are weakly resistant to the externally applied strain. For the toner also, the yield value in stress relaxation measurements is believed to similarly represent the resistance of the toner to external stresses and thus to represent the stability with respect to external stimuli and the stability with respect to environmental changes.

Thus, for example, in the case of standing at high temperatures, this thermal energy and load become external stresses and act on the toner. For the present invention, it was thought that this energy, e.g., the heat and physical shear, could be applied in the form of an initial strain and the environmental stability and stress resistance could be monitored by measuring the relaxation of the corresponding stress. While measurement of the yield value A is carried out in the present invention with the toner converted into a plate, this does not include a step of mounting in the measurement instrument through the application of heat, and as a consequence the toner particles do not undergo melting and measurement results are obtained that reflect information on the particle interfaces.

With regard to the yield value in a stress relaxation measurement, this is considered to be the point at which elasticity is not maintained with increasing stress and the molecules begin to move and thus is the point at which viscosity is displayed.

Thus, the yield value is the point of transition from the region in which elasticity dominates to the region in which viscosity dominates, and larger yield values indicate longer times for which elasticity is maintained and indicate greater resistance to external stresses. Lower yield stress values, on the other hand, indicate a higher responsiveness in terms of deformation in response to external stress and thus a lower resistance to external stress.

A strain is applied at the start of the measurement (this is also referred to in the following as the initial strain or initial applied strain value) in the stress relaxation measurements of the present invention, and this initial strain is considered to simulate a state of stress application to the toner. The initial strain is set to 0.1% in the present invention. According to the results of investigations by the present inventors, this is considered to be an initial strain value that makes possible the selective collection of information from the vicinity of the surfaces at which stress is first applied to the toner. Thus, this initial strain value is a value that can monitor the changes in the vicinity of the surfaces at which the largest application of external stress occurs and is thought to be the most suitable strain value for evaluating the stress resistance of the toner.

The present inventors believe as follows with regard to the reasons why endowing the magnetic toner of the present invention with a substantial environmental resistance under severe environments makes possible the co-existence of the low-temperature fixability with an improved dot reproducibility and developing performance under severe environments.

In order to achieve the desired environmental resistance, it is crucial in the present invention to improve the stress resistance by controlling the value of the yield value A at 25° C.—when the toner is subjected to a stress relaxation measurement using a rotating plate rheometer—to at least $3\times10^6$ (sec). The value of this yield value A is preferably at least $3.0\times10^6$ and not more than $1.0\times10^{10}$ (sec) and more preferably is at least $5.0\times10^6$ and not more than $1.0\times10^8$ (sec).

The reasons for the selection of 25° C. in the present invention are as follows. Printers are generally used in an indoor environment, and as a consequence the temperature assumed for this is from about 10 to 40° C. 25° C., which is the corresponding average temperature, is thus suitable for evaluating the properties of a toner for printer service. In addition, since a high correlation was also confirmed with the results for the printer developing performance in the present invention, the evaluation was performed using 25° C. for the reference temperature.

The present inventors consider the state of occurrence of the magnetic body and an increased compatibility between the magnetic body and the resin surrounding the magnetic body to be critical in the present invention for controlling the value of the yield value A to at least $3\times10^6$ (sec).

An essential point with regard to the state of occurrence of the magnetic body is that this is a state in which the magnetic body is segregated to the toner surface and forms a pseudo-shell (this state is also referred to below as a magnetic shell structure).

Investigations have been carried out in the past on magnetic shell structures. However, the investigations have been taken further in the present invention, including into the state of the dispersion of the magnetic body that forms the magnetic shell, and the points brittle to stress, and thus the points of low resistance to stress, were reduced by inhibiting the aggregation of the magnetic body in the magnetic shell structure. The value of the yield value at 25° C. is controlled based on this into the range specified by the present invention. A binding effect by the binder resin is absent for aggregates of a metal powder such as the magnetic body, as compared to the case in which the metal powder is microdispersed and bonded with the binder resin, resulting in the formation of points that are brittle to external stresses. Due to this, the effect from the binder resin-containing magnetic shell structure is weakened and brittleness to outside stresses occurs and the desired environmental stability and stress resistance cannot be obtained.

On the other hand, it is thought that, by controlling the magnetic body that forms the magnetic shell structure into a microdispersed state, a large contact area with the binder resin can be obtained and a dramatic increase in the resistance to external stress is obtained due to the adherence between the magnetic body and the binder resin.

It is thought that the value of the 25° C. yield value A can be controlled to at least $3\times10^6$ (sec) by controlling the state of the dispersion of the magnetic body in this manner, making it possible to achieve a greater environmental stability and stress resistance than heretofore available.

When the value of the above-described 25° C. yield value A is less than $3\times10^6$ (sec), there is a deterioration in the environmental stability and stress resistance of the toner and the toner is easily degraded by standing in a severe environment, such as high temperatures/high humidities, an impaired toner charging performance and flowability are seen, and the desired dot reproducibility and durability of the density stability can not be obtained.

The execution of a uniform hydrophobic treatment on the magnetic body is an example of a method for controlling the value of the yield value A into the above-described range by bringing about a microdispersion of the magnetic body constituting the magnetic shell structure when a magnetic shell structure has been established. The selection of the hydrophobic treatment agent for the magnetic body, the amount of the hydrophobic treatment agent, and the optimization of the treatment conditions are specific considerations here, and the details are discussed below.

On the other hand, it is essential for achieving a desirable low-temperature fixability for the magnetic toner of the present invention that the 25° C. yield value B, which is measured on the toner after heating to 80° C. and then cooling to 25° C., be controlled to not more than $1\times10^5$ (sec) in a stress relaxation measurement using a rotating plate rheometer. In addition, the value of this yield value B is preferably at least $1.0\times10^2$ and not more than $1.0\times10^5$ (sec) and more preferably is at least $5.0\times10^2$ and not more than $5.0\times10^4$ (sec).

According to investigations by the inventors, the 25° C. yield value B, which is measured after heating to 80° C., correlates with the initial melting temperature during fixing. The fact that this value is lower than the yield value A indicates that, due to the heating at 80° C., softening temporarily occurs in the vicinity of the toner surface, the state of occurrence of the magnetic body changes, and a change to a rigid magnetic shell structure is produced.

In an ordinary fixing step, the toner is melted using a temperature of at least 100° C. and is fixed to a medium such as paper, but it is thought that a toner structure that can commence fixing at around 80° C. is actually required due to diffusion of the temperature to the paper and in order to shorten the fixing time as speeds increase. The investigations associated with the present invention also demonstrated that bringing the 25° C. yield value B, which is measured after heating to 80° C., to the desired value is an effective evaluation for the low-temperature fixability and this yield value B was adopted as an index as a result.

The inventors hold as follows with regard to the factors that can achieve the sharp softening represented by the change from yield value A to yield value B in the present invention.

As discussed above, in the toner of the present invention, the magnetic body in a microdispersed state forms a magnetic shell structure and a high degree of contact between the resin and magnetic body also occurs. Due to this, the binder resin is present around the magnetic body and a shell layer is formed that is more rigid than in the past.

However, by optimizing the degree of branching in the binder resin and the type of release agent, the plasticizing effect by the release agent on the resin can be raised and, while softening of the resin of course occurs, it is thought that the state of occurrence of the magnetic body is also changed.

Thus, it is thought that in the present invention the rigid magnetic shell condition can be relaxed during the above-described heating and a transition can be brought about to a relaxed magnetic shell state; the toner then has little elasticity and a sharp toner softening can be achieved.

The toner fixation temperature in the present invention is 80° C., which is a low-temperature region. It is thought that the desired low-temperature fixability can be achieved because a satisfactory amount of deformation is obtained even at low amounts of heat through the generation of the relaxation of the magnetic shell state as described above.

When the post-80° C. heating 25° C. yield value B is larger than $1\times10^5$ (sec), the toner exhibits a low softenability and an adequate deformation of the toner during fixing is not obtained and as a consequence the desired low-temperature fixability is not obtained.

The stability of the environmental resistance is dramatically raised by: forming a magnetic shell with the magnetic body as thus described; controlling the structure of the binder resin surrounding the magnetic body; and improving the contact and adhesiveness between the magnetic body and the resin, while the low-temperature fixability of the toner is substantially improved by bringing about relaxation of the rigid magnetic shell state in the toner during fixing.

With regard to the radius of gyration (Rw) and the weight-average molecular weight (Mw) of the tetrahydrofuran (THF)-soluble fraction of the magnetic toner of the present invention as measured using size exclusion chromatography with a multiangle laser light scattering (SEC-MALLS), the weight-average molecular weight (Mw) is preferably at least 5,000 and not more than 25,000 and the weight-average molecular weight (Mw) and the radius of gyration (Rw) preferably satisfy the following equation 1. A unit used for the radius of gyration is "nm".

$$1.0\times10^{-3}\leq Rw/\mathrm{Mw}\leq1.0\times10^{-2} \qquad \text{equation (1)}$$

The THF-soluble fraction in the magnetic toner of the present invention is thought to be the molecular weight zone that is significantly influenced by the plasticizing effect of the release agent. On the other hand, mean square radius ($Rg^2$) is a value that generally represents the extension per molecule, and the value [Rw/Mw] given by dividing a root value of the radius of gyration Rw ($Rw=(Rg^2)^{1/2}$) by the weight-average molecular weight (Mw) is taken to represent the degree of branching per molecule. Accordingly, it is thought that the smaller the [Rw/Mw], the smaller the extension per the molecular weight and as a consequence the larger the degree of branching in the molecule; conversely, the larger the [Rw/Mw], the larger the extension per the molecular weight and as a consequence a straight-chain molecule is indicated.

By specifying in the present invention that the THF-soluble fraction of the magnetic toner have a weight-average molecular measured by SEC-MALLS of at least 5,000 to not more than 25,000 and a relationship between the weight-average molecular weight (Mw) and the radius of gyration (Rw) of $1.0\times10^{-3}\leq Rw/Mw\leq1.0\times10^{-2}$, a branching state is achieved in which a plasticizing effect is obtained for the release agent, which has a relatively small molecular weight in comparison to the binder resin. As a consequence, when heating is performed, the release agent brings about an increased plasticizing effect for the binder resin, which is present around the magnetic body, and relaxation of the magnetic shell structure is promoted. This results in a promotion of the change from the yield value A to the yield value B and an increase in the low-temperature fixability.

The weight-average molecular weight (Mw) is more preferably from at least 8,000 to not more than 22,000 and even more preferably is from at least 10,000 to not more than 20,000.

On the other hand, [Rw/Mw] is more preferably from at least $2.0\times10^{-3}$ to not more than $8.0\times10^{-3}$ and even more preferably from at least $2.5\times10^{-3}$ to not more than $7.0\times10^{-3}$.

The weight-average molecular weight (Mw) can be controlled into the above-described range by adjusting, for example, the type of the reaction initiator, the amount of the reaction initiator, the reaction temperature, and so forth. [Rw/Mw] can be controlled into the above-described range by adjusting the type of the reaction initiator, the amount of the reaction initiator, the reaction temperature, the supplemental addition of the reaction initiator, and the timing of reaction initiator addition.

The radius of gyration and weight-average molecular weight determined by SEC-MALLS are described in the following. The molecular weight distribution measured by SEC is based on molecular size, while the intensity is the amount of a molecule that is present. In contrast to this, the utilization of the light scattering intensity obtained by SEC-MALLS (SEC, used as the separation technique, is coupled with a multiangle light scattering detector, making possible measurement of the weight-average molecular weight (Mw) and the molecular extension (radius of gyration)) enables the determination of a molecular weight distribution not based on molecular size.

In the conventional SEC technique, the molecular weight is measured by passing the molecules to be measured through a column, at which time they are subjected to a molecular sieving action and are eluted in sequence beginning with molecules having a larger molecular size. In this case, for a linear polymer and a branched polymer having the same molecular weight, the former, because it has a larger molecular size in solution, elutes more rapidly. Accordingly, the molecular weight measured by SEC for a branched polymer is generally smaller than the true molecular weight. On the other hand, the light scattering technique used by the present invention utilizes the Rayleigh scattering of the measured molecules. In addition, by carrying out measurement of the dependence of the intensity of the scattered light on the angle of incidence of the light and sample concentration and performing analysis using, for example, the Zimm or Berry method, a molecular weight (absolute molecular weight) even closer to the true molecular weight can be determined for linear polymers and all molecular configurations of a branched polymer. In the present invention, the mean square radius ($Rg^2$) and the weight-average molecular weight (Mw) based on the absolute molecular weight were derived by measuring the intensity of the scattered light using the SEC-MALLS measurement procedure described below and analyzing the relationship represented by the Zimm equation, infra, using a Debye plot.

A Debye plot is a graph in which K·C/R (θ) is plotted on the y-axis and $\sin^2(\theta/2)$ is plotted on the x-axis, and Mw (weight-average molecular weight) can be calculated from the intercept with the y-axis and the mean square radius $Rg^2$ can be calculated from the slope.

However, since Mw and Rw are calculated for each elution time, their average values must be further calculated in order to obtain Mw and Rw for the sample as a whole.

When the measurements were performed using the instrument described below, the values of the radius of gyration (Rw) and the weight-average molecular weight (Mw) for the sample as a whole were obtained as direct output from the instrument.

$$\frac{K\cdot C}{R(\theta)} = \frac{1}{Mw}\cdot\frac{1}{P(\theta)} \text{ Zimm expression} \qquad \text{[Expression 1]}$$

$$\cong \frac{1}{Mw}\left[1+\langle Rg^2\rangle\sin^2\left(\frac{\theta}{2}\right)\cdot 16\pi^2/3\lambda^2\right]$$

K: optical constant

C: polymer concentration (g/mL)

R(θ): relative intensity of the scattered light at scattering angle θ

Mw: weight-average molecular weight

P(θ): factor showing the angular dependence of the scattered light $$P(\theta)=R(\theta)/R_0=1-\langle Rg^2\rangle\ [(4\pi/\lambda)\sin(\theta/2)]^2/3$$

$\langle Rg^2\rangle$: mean square radius

λ: wavelength (nm) of the laser light in the solution

While the magnetic toner of the present invention can be produced by any known method, the magnetic toner particles are preferably produced in an aqueous medium in order to form the rigid shell layer that originates with the magnetic shell structure generated by the magnetic body as described in the above explanation.

Dispersion polymerization methods, aggregation methods, solution suspension methods, suspension polymerization methods, and so forth are examples of production methods in aqueous media. The production of the magnetic toner particles by a suspension polymerization method is particularly preferred for the present invention because this enables an effective utilization of the different polarities of the constituent materials of the toner particles and facilities achieving the properties specified by the present invention.

While a suspension polymerization method is described in the following, there is no limitation to this. A polymerizable monomer composition is first obtained by dissolving or dispersing the following to uniformity: a polymerizable monomer, magnetic body, and release agent and optionally a polymerization initiator, crosslinking agent, charge control agent, and other additives. This polymerizable monomer composition is then dispersed, using a suitable stirrer, in a continuous layer (for example, an aqueous phase) that contains a dispersion stabilizer, while a polymerization reaction is carried out at the same, thus yielding toner particles having a desired particle diameter.

Since the individual toner particles of the toner obtained by this suspension polymerization method (hereafter also referred to as "polymerized toner") uniformly have an almost spherical shape, this is an effective production method for promoting uniform charging.

The magnetic toner of the present invention contains a magnetic body. The magnetic body is preferably a magnetic body that has been subjected to a hydrophobic treatment (also referred to hereafter as a treated magnetic body). This treated magnetic body is provided by treating the surface of an untreated magnetic body with a hydrophobic treatment agent, which is described below.

The magnetic body has a magnetic iron oxide such as magnetite and γ-iron oxide as its main component and may contain elements such as phosphorus, cobalt, nickel, copper, magnesium, manganese, aluminum, silicon, and so forth. In addition, the magnetic body has a BET specific surface area, as measured by nitrogen adsorption, preferably of from at least 2.0 to not more than 30.0 $m^2/g$ and more preferably from at least 3.0 to not more than 28.0 $m^2/g$. The shape of the magnetic body may be polyhedral, octahedral, hexahedral, spherical, acicular, scale-like, and so forth, while shapes that present little anisotropy, such as polyhedral, octahedral, hexahedral, and spherical, are preferred from the standpoint of increasing the image density.

The use amount for the magnetic body, given per 100 mass parts of the binder resin, is preferably from at least 50 to not more than 130 mass parts and is more preferably from at least 70 to not more than 110 mass parts. The magnetic body can be produced, for example, by the following method. An aqueous solution containing ferrous hydroxide is prepared by adding an equivalent or more—with respect to the iron component—of a base, e.g., sodium hydroxide, to an aqueous ferrous salt solution. A seed crystal, which will form the core of the magnetic iron oxide particle, is first produced by bubbling in air while maintaining the pH of the prepared aqueous solution at pH 7.0 or more and carrying out oxidation of the ferrous hydroxide while heating the aqueous solution to at least 70° C.

Then, an aqueous solution that contains approximately 1 equivalent of ferrous sulfate with reference to the amount of addition of the previously added base, is added to the slurry that contains the seed crystal. The reaction of the ferrous hydroxide is developed while maintaining the pH of the mixture from at least 5.0 to not more than 10.0 and bubbling in air in order to grow magnetic iron oxide particles using the seed crystals as a core. The shape and magnetic properties of the magnetic body can be controlled here by selection of the pH, reaction temperature, and stirring conditions as desired. While the pH of the solution transitions into the acid range as the oxidation reaction develops, the pH of the solution preferably does not fall below 5.0. The magnetic body obtained in the described manner is filtered, washed, and dried by conventional methods to yield the magnetic body.

There are no particular limitations on the hydrophobic treatment agent used to produce the above-described treated magnetic body and heretofore known hydrophobic treatment agents can be used; however, silane compounds are preferred. The method described in the following is a favorable example of the treatment of the surface of the magnetic body with a silane compound.

There are three types of methods for treating the surface of the magnetic body with a silane compound: dry methods, water-based wet methods, and wet methods in a solvent (also referred to herebelow as solvent wet methods).

In a dry surface treatment method, the silane compound is introduced to the washed, filtered, and dried magnetic body and the surface treatment is performed in the gas phase.

To carry out surface treatment in a water-based wet surface treatment method, the product provided by drying after the completion of the oxidation reaction is redispersed in an aqueous medium that contains the silane compound in order to perform the surface treatment, or the iron oxide particles obtained by washing and filtration after the completion of the oxidation reaction are redispersed, without drying, in an aqueous medium that contains the silane compound in order to perform the surface treatment.

To carry out surface treatment in a solvent wet method, the product provided by drying after the completion of the oxidation reaction is redispersed in a solvent and a silane compound is added to the dispersion in order to perform the surface treatment.

The hydrophobic treatment agent is preferably selected as appropriate in the present invention in order to carry out a uniform surface treatment. An alkylalkoxysilane with the following general formula (A) is preferred for the silane compound used for the hydrophobic treatment agent $$R_mSiY_n \quad (A)$$

wherein R represents an alkoxyl group; m represents an integer from at least 1 to not more than 3; Y represents an alkyl group; n represents an integer from at least 1 to not more than 3; and m+n=4.

The above-described alkoxyl group preferably has from 1 to 3 carbons and more preferably has 1 or 2 carbons. The alkyl group preferably has from 2 to 20 carbons and more preferably from 2 to 10 carbons, even more preferably from 2 to 6 carbons, and particularly preferably from 2 to 4 carbons.

The alkylalkoxysilane represented by general formula (A) can be exemplified by diethyldimethoxysilane, ethyltriethoxysilane, ethyltrimethoxysilane, diethyldiethoxysilane, diethyldimethoxysilane, triethylmethoxysilane, n-propyltriethoxysilane, n-propyltrimethoxysilane, isopropyltriethoxysilane, isopropyltrimethoxysilane, n-butyltrimethoxysilane, n-butyltriethoxysilane, isobutyltrimethoxysilane, isobutyltriethoxysilane, and n-hexyltrimethoxysilane.

Among the above-described alkylalkoxysilanes, alkyltrialkoxysilanes represented by the following general formula (B) are more preferred from the standpoint of imparting a high hydrophobicity to the magnetic body $$C_pH_{2p+1}—Si—(OC_qH_{2q+1})_3 \quad (B)$$

wherein p is an integer from at least 2 to not more than 20 and q is an integer from at least 1 to not more than 3.

p is preferably from at least 2 to not more than 10, more preferably is from at least 2 to not more than 6, and even more preferably is from at least 2 to not more 4.

By using at least 2 to not more than 20 for p, the bulkiness of the alkyltrialkoxysilane can be restrained and steric hindrance can thereby be inhibited, while still maintaining the hydrophobicity. This makes it possible as a result for the hydrophobicity to co-exist with a uniform surface treatment for the magnetic body and is therefore preferred. When p is less than 2, a satisfactory hydrophobicity cannot be imparted to the treated magnetic body. When p is larger than 20, a high hydrophobicity is obtained, but it becomes difficult to control the state of the treated magnetic body in the magnetic toner.

The bulkiness of the alkylalkoxysilane can be particularly restrained in the present invention when p is at least 2 and not more than 4, which makes possible additional increases in the uniformity of the surface treatment and inhibits variabilities in the state of occurrence in the toner.

On the other hand, when q is larger than 3, the alkyltrialkoxysilane exhibits a diminished reactivity and it becomes difficult to carry out a satisfactory hydrophobing. Thus, the use is preferred of an alkyltrialkoxysilane in which q represents an integer from 1 to 3 (more preferably the integer 1 or 2).

A single alkylalkoxysilane may be used or a plurality may be used in combination. When a plurality is used, the treatment may be performed by using each alkylalkoxysilane by itself or a simultaneous treatment may be performed.

The amount of use of the silane compound used in the hydrophobic treatment is preferably from at least 0.01 to not more than 10 mass parts per 100 mass parts of the untreated magnetic body and more preferably is from 0.1 to not more than 8 mass parts per 100 mass parts of the untreated magnetic body.

In addition, a silane compound provided by the hydrolysis of an alkylalkoxysilane is preferred for the silane compound used in the present invention. The hydrolysis of the alkylalkoxysilane prior to its use for surface treatment of the magnetic body promotes adsorption to the surface of the magnetic body and makes possible a uniform coating of the magnetic body by the silane compound. The hydrolysis proportion (the hydrolysis proportion is defined below) for the alkylalkoxysilane is preferably at least 50% and more preferably is at least 70%. When surface treatment uses a wet method and hydrolysis of the alkylalkoxysilane has not been performed in advance, hydrolysis of the alkylalkoxysilane and adsorption to the surface of the magnetic body are performed concurrently in the surface treatment step. With regard to the timing of adsorption in this case, since it occurs by interaction between an OH group in the alkylalkoxysilane and an OH group on the surface of the magnetic body, the alkylalkoxysilane ends up being randomly adsorbed independently of the hydrolysis proportion and condensation proportion for the alkylalkoxysilane. This results in a tendency for unevenness to be produced in the treatment status of the surface of the magnetic body.

In dry methods, on the other hand, the alkylalkoxysilane exhibits a poorer adsorbability to the surface of the magnetic body and the uniformity of the treatment status also tends to be lower.

When the alkylalkoxysilane undergoes hydrolysis, its terminals become OH groups, raising the affinity with OH groups present on the surface of the untreated magnetic body. This serves to facilitate adsorption by the alkylalkoxysilane to the surface of the untreated magnetic body and as a consequence the surface can be thoroughly coated and there is little likelihood that untreated areas will remain present.

A magnetic body with a constant or prescribed hydrophobicity can be produced when a silane compound is used that has been produced by hydrolysis of an alkylalkoxysilane as described above, as a consequence of which the dispersion of the magnetic body throughout the toner can be made uniform and the elaboration of the magnetic shell within the toner can also be further promoted. As a result, even during long-term image output, an even greater resistance to the occurrence of a deterioration in toner chargeability is obtained and an even better maintenance of the image density under a high temperature/high humidity environment is made possible.

The above-described alkylalkoxysilane can be hydrolyzed, for example, by the following method.

Hydrolysis can be performed by gradually introducing the alkylalkoxysilane into an aqueous solution with a pH adjusted to from 4 to not more than 6 while uniformly dispersing by stirring, for example, using a disperser blade, and adjusting the dispersing time so as to obtain the desired hydrolysis proportion. The alkylalkoxysilane forms an emulsion when a dispersing apparatus that can apply a high shear is used, resulting in a dramatic increase in the area of contact between the water and alkylalkoxysilane and enabling the hydrolysis proportion to be increased under conditions that maintain a low siloxane proportion. The adjustment of the pH during hydrolysis is also very important at this time. When the pH is too high or too low, the condensation reaction by the silane compound proceeds or there is almost no development of the hydrolysis reaction. Since the pH region that enables adjustment to the desired hydrolysis proportion and siloxane proportion varies as a function of the type of alkylalkoxysilane used, suitable adjust of the pH must be carried out while measuring the hydrolysis proportion and siloxane proportion. Like this, an aqueous solution produced by hydrolysis of alkylalkoxysilane can be obtained.

As noted above, there are three main methods for treating the surface of the magnetic body, i.e., dry methods, water-based wet methods, and solvent wet methods. Regardless of the method used, it is thought that passage through the surface treatment step results in the silane compound being adsorbed to the surface of the magnetic body by hydrogen bonding. Accordingly, the dehydration condensation reaction is preferably developed after the surface treatment step by carrying out a drying step (also referred to hereafter as the heat treatment step). Condensation of the silane compound and bonding by the silane compound to the surface of the magnetic body occur in this heat treatment step. Accordingly, heat conduction is preferably made uniform in order to uniformly develop condensation of the silane compound and a bonded state by the silane compound to the surface of the magnetic body.

In a first example of a specific measure for this, a deagglomeration step is added prior to the heat treatment step and the unevenness of heat conduction into the treatment substrate during heat treatment is reduced by bringing the treatment substrate to approximately a primary dispersion system prior to heat treatment. In a second example, a heat treatment (drying) is performed at a relatively low temperature at the start of the heat treatment, and, after the moisture fraction has been reduced, the temperature is shifted to high temperatures in order to develop the thermal condensation of the silane compound and bonding to the magnetic body. These make possible condensation of the silane compound on the surface of the magnetic body, an homogenization of the surface treatment state throughout the magnetic body, and an inhibition of magnetic body aggregation. The result is to make possible an improved microdispersibility of the magnetic body during toner granulation.

The pulverizing apparatus used in the above-described deagglomeration step can be exemplified by jet mills, impact grinders, pin mills, hammer mills, and media-based deagglomerators such as sand mills, grain mills, basket mills, ball mills, sand grinders, viscomills, and so forth.

Dry methods and solvent wet methods are methods preferred in the present invention for treating the surface of the magnetic body because a rigid shell layer is then formed by the magnetic body and because they facilitate control of the magnetic body into a microdispersed state and facilitate adjustment of the above-described yield values into the prescribed ranges.

The reason for this is thought to be as follows. Since only a little water is present in the reaction system in dry methods and solvent wet methods, the formation of hydrogen bonds between water and hydrophilic groups present in the silane compound is inhibited. The extent of hydrogen bonding between the silane compound and the surface of the magnetic body is therefore higher than in water-based wet methods, where water is present, and the hydrophobic treatment can therefore be performed more uniformly and efficiently.

In addition, when hydrophilic groups in the silane compound form hydrogen bonds with water and in this water-trapping state adsorb to the magnetic body surface and react, hydrophilic groups remain unreacted on the surface of the treated magnetic body. When hydrophilic groups are present in large numbers on the magnetic body during toner granulation, variability is readily produced in the segregation of the magnetic body since the hydrophilic groups are readily compatible with water. This impairs the progress of rigid magnetic shell formation. Dry methods and solvent wet methods that use a preliminarily hydrolyzed silane compound can prevent the problems originating with such hydrogen bonding and can achieve additional improvements in magnetic shell formation through uniform coating by the silane compound. In addition, since they can achieve a microdispersion of the magnetic body and an increase in the area of contact with the binder resin, they offer advantages with regard to the elaboration of the rigid shell layer by the magnetic body.

A specific example of the above-described dry method is described in the following. Dry methods include methods in which treatment is performed by causing volatilization of the silane compound, methods in which an aqueous solution of the silane compound is sprayed onto the magnetic body using an apparatus such as a spray drier, and methods in which the magnetic body is stirred and mixed with an aqueous solution of the silane compound while applying shear using an apparatus such as, for example, a Henschel mixer. Among the preceding, methods in which treatment is performed using a stirring apparatus such as a Henschel mixer are simple and convenient and are therefore preferred. When these methods are used, the aqueous solution of the silane compound is added dropwise while stirring the untreated magnetic body, after which a magnetic body having the hydrolyzate of the silane compound adsorbed to its surface is obtained by additional stirring and mixing. The hydrophobic-treated magnetic body is then obtained by developing the condensation reaction by the application of heat.

In a solvent wet method, on the other hand, magnetic body having the hydrolyzate of the silane compound adsorbed to its surface is obtained by the dropwise addition of an aqueous solution of the silane compound while dispersing the untreated magnetic body in a solvent such as ethanol. The hydrophobic-treated magnetic body is then obtained by developing the condensation reaction by the application of heat.

In accordance with the preceding, the uniform coating and treatment by the hydrophobic treatment agent is preferably performed in the production of the treated magnetic body after the magnetic body has been produced.

In the case of the above-described dry method, contact generally occurs among the magnetic body and as a result aggregation of the treated magnetic body is particularly prone to occur in the production process. Accordingly, aggregation can be reduced, as described above, by adding a deagglomeration step prior to the heat treatment step. The ratio of the BET specific surface area (S2) of the treated magnetic body to the BET specific surface area (S1) of the magnetic body that has not been subjected to the above-described surface treatment is preferably used in order to accurately assess this state of aggregation. This S1 and S2 preferably satisfy the following equation 2 in the present invention.

$$S2/S1 \geq 0.70 \qquad \text{equation (2)}$$

The BET specific surface area (S1) of the magnetic body represents the BET specific surface area of the magnetic body before the hydrophobic treatment, while the BET specific surface area (S2) of the treated magnetic body represents the BET specific surface area of the magnetic body in the state after the hydrophobic treatment has been performed, i.e., in the state used during toner production.

A ratio S2/S1 greater than or equal to 0.70 indicates that there is little magnetic body that has become aggregated during the hydrophobic treatment of the magnetic body. The magnetic body will as a consequence have a microdisperse state during toner production and the state of the dispersion of the magnetic body in the toner particle will be excellent. As a result, variabilities not only in the durability, but also in charging are reduced, and toner with charging defects can be prevented and as a consequence fogging can be inhibited. This fogging refers to the presence of toner, for which an appropriate control of charging has not been possible, in non-image areas of the medium on which an image was not originally present.

In order to provide a preferred state of dispersion in the present invention, S1 is preferably from at least 5.0 to not more than 12.0 ($m^2/g$) and more preferably is from at least 6.0 to not more than 10.0 ($m^2/g$).

The dielectric loss tangent (tan δ) of the magnetic toner of the present invention at a frequency of $1.0\times10^4$ Hz is preferably in the range from at least $1.0\times10^{-2}$ to not more than $2.5\times10^{-2}$. The dielectric loss tangent (tan δ) of the toner at a frequency of $1.0\times10^4$ Hz depends on the dispersion of the magnetic body throughout the toner and on the dispersion of the magnetic body in the toner.

Controlling the dielectric loss tangent (tan δ) of the toner at a frequency of $1.0\times10^4$ Hz into the range from at least $1.0\times10^{-2}$ to not more than $2.5\times10^{-2}$ creates conditions in the present invention that are more conducive to the formation of a rigid magnetic shell by the microdispersed magnetic body, and as a consequence is preferred since this provides an even better durability by the developing performance after standing under a high temperature/high humidity environment. Control of tan δ in particular is preferably performed by achieving a uniform surface treatment of the magnetic body and by an appropriate selection of the type of treatment agent.

Another colorant may be used in the present invention in combination with the above-described treated magnetic body. Co-usable colorants can be exemplified by the known dyes and pigments as well as magnetic inorganic compounds and nonmagnetic inorganic compounds. Specific examples are particles of a ferromagnetic metal such as cobalt and nickel; alloys provided by the addition to the preceding of, for example, chromium, manganese, copper, zinc, aluminum, or a rare-earth element; dyes/pigments such as titanium black, nigrosine, and particles such as hematite; as well as carbon black and phthalocyanine. These are also preferably used after the same surface treatment as for the above-described magnetic body.

The polymerizable monomer comprising the polymerizable monomer composition in the above-described suspension polymerization method can be exemplified by monomers such as styrene-based monomers such as styrene, o-methylstyrene, m-methylstyrene, p-methylstyrene, p-methoxystyrene, p-ethylstyrene, and so forth; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate, and so forth; methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, and so forth; and also acrylonitrile, methacrylonitrile, acrylamide, and so forth. A single one of these monomers can be used or a mixture of these monomers can be used. Among the preceding monomers, the use is preferred, from the standpoints of the developing characteristics and durability of the toner, of styrene or a styrene derivative, either singly or mixed with another monomer.

The weight-average molecular weight (Mw) and radius of gyration (Rw) of the tetrahydrofuran (THF)-soluble fraction of the toner, as measured by size exclusion chromatography with a multiangle laser light scattering (SEC-MALLS), is preferably controlled in the present invention into particular ranges.

Thus, when, for example, the toner of the present invention is produced by a suspension polymerization method, the above-described weight-average molecular weight (Mw) and radius of gyration (Rw) of the binder resin can be brought into the prescribed ranges by controlling the reactivity of the polymerizable monomer.

Specifically, in order to provide the binder resin with a branching structure, techniques are available such as bringing about branching by inducing, for example, a hydrogen abstraction reaction during polymerization.

A hydrogen abstraction reaction can be achieved by a technique such as sharply raising the radical concentration during polymerization. This technique can be exemplified by the supplemental addition of a polymerization initiator that has a half-life temperature that is at least 10° C. and more preferably at least 15° C. lower than the polymerization temperature during polymerization, or by the execution of an oxidation-reduction reaction (redox reaction) at high polymerization temperatures. As a general matter, an advantage for the oxidation-reduction reaction is that the polymerization temperature can be lowered and polymerization can progress under moderate conditions; however, by carrying out the oxidation-reduction temperature at high temperatures, polymerization undergoes vigorous development and the hydrogen abstraction reaction actively occurs.

Changing the timing of the oxidation-reduction reaction and the amount of supplemental addition of polymerization initiator and the timing for the polymerization initiator are effective for controlling as desired the degree of resin branching by sharply raising the radical concentration. Specifically, the oxidation-reduction reaction is preferably carried out, or a supplemental addition of polymerization initiator is preferably made, when the conversion of the polymerizable monomer is from at least 30 to no more than 70%. More preferred is a second supplemental addition of polymerization initiator when the conversion is from at least 30 to no more than 70%; this enables fine control of the degree of branching of the binder resin.

In particular, the molecular chain length, which relates to the radius of gyration (Rw), can be adjusted by controlling the reactivity at the start of the polymerization through selection of the type and amount of the polymerization initiator, appropriate selection of the corresponding reaction temperature, and also through an oxidation-reduction reaction or supplemental addition of polymerization inhibitor.

The polymerization initiator used in the present invention preferably has a half-life in the polymerization reaction of from at least 0.5 to not more than 20.0 hours. The amount of addition of the polymerization initiator is preferably from at least 0.5 to not more than 20.0 mass parts per 100 mass parts of the polymerizable monomer. More preferably, from at least 2.0 to not more than 15.0 mass parts is preferred for controlling to the weight-average molecular weight (Mw) of the present invention.

The polymerization initiator can be specifically exemplified by azo-type and diazo-type polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and so forth, and peroxide-type polymerization initiators such as di(secondary)butylperoxy dicarbonate, benzoyl peroxide, dilauroyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxy pivalate, t-butylperoxy neoheptanoate, and so forth.

A crosslinking agent may also be used. A compound having a polymerizable double bond is used as this crosslinking agent, for example, an aromatic divinyl compound such as divinylbenzene, divinylnaphthalene, and so forth; a carboxylate ester having two double bonds, such as ethylene glycol diacrylate, ethylene glycol dimethacrylate, 1,3-butanediol dimethacrylate, 1,6-hexanediol diacrylate, and so forth; or a divinyl compound such as divinylaniline, divinyl ether, divinyl sulfide, divinyl sulfone, and so forth; a single one of these may be used or a mixture may be used.

A release agent is incorporated in the toner of the present invention in order to improve the fixing performance. All known release agents can be used as this release agent. This specifically includes petroleum waxes such as paraffin wax, microcrystalline wax, petrolactam, and so forth, and derivatives thereof; montan wax and derivatives thereof; hydrocarbon waxes produced by the Fischer-Tropsch method and derivatives thereof; polyolefin waxes as typified by polyethylene, and derivatives thereof; natural waxes such as carnauba wax, candelilla wax, and so forth, and derivatives thereof; and ester waxes. The derivatives referenced here encompass the oxides, block copolymers with vinylic monomers, and graft modifications. In addition, a monofunctional ester wax or a multifunctional ester wax, e.g., most prominently a difunctional ester wax, but also a tetrafunctional or hexafunctional ester wax, can be used as the ester wax. Two or more of these release agents can be used in combination.

The content of the release agent is preferably from at least 1 to not more than 40 mass parts per 100 mass parts of the binder resin. From at least 2 to not more than 30 mass parts is more preferred.

The melting point of the release agent in the present invention is preferably from at least 50 to not more than 80° C. When the melting point of the release agent is from at least 50 to not more than 80° C., a plasticizing effect for the resin is obtained in a temperature range sufficiently below the temperature during fixing—while maintaining the storage stability, and as a consequence a large relaxation effect for the magnetic shell state is also obtained and the low-temperature fixability is further enhanced.

When the above-described suspension polymerization method is used, the polymerizable monomer composition—generally prepared by the suitable addition of the above-described toner composition and so forth and dispersion or dissolution to uniformity with a dispersing apparatus such as, for example, a homogenizer, ball mill, or ultrasound disperser—is suspended in an aqueous medium containing the dispersion stabilizer. The particle diameter of the obtained toner particles can be sharpened at this point by instantaneously providing the desired toner particle size using a high-speed dispersing apparatus such as a high-speed stirrer or an ultrasound disperser.

After granulation, stirring sufficient to maintain the particulate state and stop the particles from floating and sedimenting may be performed using an ordinary stirrer.

Known surfactants, organic dispersing agents, and inorganic dispersing agents can be used as the above-described dispersion stabilizer. Among the preceding, the use of an inorganic dispersing agent is preferred because this resists the production of toxic fines, prevents the stability from collapsing even when the reaction temperature varies because dispersion stability is provided through steric hindrance, is also easily washed, and resists exercising negative effects on the toner. This inorganic dispersing agent can be exemplified by the polyvalent metal salts of phosphoric acid, such as tricalcium phosphate, magnesium phosphate, aluminum phosphate, zinc phosphate, hydroxyapatite, and so forth; carbonates such as calcium carbonate, magnesium carbonate, and so forth; inorganic salts such as calcium metasilicate, calcium sulfate, barium sulfate, and so forth; and inorganic compounds such as calcium hydroxide, magnesium hydroxide, aluminum hydroxide, and so forth. These inorganic dispersing agents are preferably used in an amount of from at least 0.20 to not more than 20.00 mass parts per 100 mass parts of the polymerizable monomer. In addition, a single one of these dispersion stabilizers may be used or a plurality may be used in combination. A surfactant may also be co-used at from at least 0.0001 to not more than 0.1000 mass part per 100 mass parts of the polymerizable monomer.

Toner particles are obtained by subjecting the obtained polymer particles to filtration, washing, and drying by known methods. The magnetic toner of the present invention can be obtained by the external addition to these toner particles of an inorganic fine powder, vide infra, and mixing in order to attach the inorganic fine powder to the surface of the toner particles. In addition, a classification step may also be introduced into the production process (prior to mixing with the inorganic fine powder) in order to remove the coarse powder and fines present in the toner particles.

The magnetic toner of the present invention may as necessary incorporate a charge control agent in order to improve the charging characteristics. Known charge control agents can be used here, while charge control agents that enable a rapid charging speed and stable maintenance of a constant or prescribed amount of charge are particularly preferred. In addition, when a suspension polymerization method is used, a charge control agent is particularly preferred that has little inhibitory action on the polymerization and that is substantially free of material soluble in the aqueous dispersion medium. Among charge control agents, the negative-type charge control agents can be exemplified by metal compounds of aromatic carboxylic acids such as salicylic acid, alkylsalicylic acid, dialkylsalicylic acid, naphthoic acid, dicarboxylic acids, and so forth; the metal salts and metal complexes of azo dyes and azo pigments; polymeric compounds having a sulfonic acid or carboxylic acid group in side chain position; boron compounds; urea compounds; silicon compounds; calixarene; and so forth. The positive-type charge control agents can be exemplified by quaternary ammonium salts, polymeric compounds having such a quaternary ammonium salt in side chain position, guanidine compounds, nigrosine compounds, imidazole compounds, and so forth.

With regard to the method of adding the charge control agent to the interior of the toner particle, the addition of the charge control agent to the polymerizable monomer composition prior to granulation is generally used when toner production is carried out by a suspension polymerization method. In addition, the toner surface can also be uniformly coated by carrying out a seed polymerization by adding polymerizable monomer in which the charge control agent has been dissolved or suspended, the addition being made either during the course of forming the oil droplets in the water and polymerizing or after the polymerization. When an organometal compound is used as the charge control agent, introduction may be carried out by adding such a compound to the toner particles and mixing and stirring with the application of shear.

The amount of use of these charge control agents is determined by the type of binder resin, whether other additives are present, and the method of producing the toner including the dispersion method, and thus cannot be definitively limited. However, in the case of internal addition to the toner particles, the range preferably of from at least 0.1 to not more than 10.0 mass parts per 100 mass parts of the binder resin and more preferably from at least 0.1 to not more than 5.0 mass parts per 100 mass parts of the binder resin is used. In the case of external addition to the toner particles, the amount of use is preferably from at least 0.005 to not more than 1.000 mass part per 100 mass parts of the toner and is more preferably from at least 0.01 to not more than 0.30 mass parts per 100 mass parts of the toner.

In order to obtain additional improvements in the durability of the developing performance, the magnetic toner of the present invention preferably has a core-shell structure in which a shell layer comprising a high molecular weight species coats a core layer. The presence of this shell layer of a high molecular weight species serves to provide the toner with uniform surface properties and to provide a uniform charging performance while improving toner flowability. In addition, since the shell layer of a high molecular weight species uniformly coats the toner particle surface layer, for example, exudation of the release agent can be inhibited even during long-term storage and the storage stability can thus be improved. A noncrystalline high molecular weight species is preferably used for this shell layer, and, viewed from the perspective of charge stability, the acid value thereof is preferably from at least 5.0 to not more than 20.0 mg KOH/g. As a specific technique for forming the shell layer comprising a high molecular weight species when toner production is carried out in an aqueous medium, fine particles intended for shell layer formation are attached to a core particle and the shell layer is formed by drying. In addition, in suspension polymerization methods, formation of the shell layer can be brought about by causing segregation of the high molecular weight species to the interface with the water, i.e., into the neighborhood of the toner surface, utilizing the hydrophilicity of the high molecular weight species intended for the shell layer. Moreover, the shell layer can be formed by causing monomer swelling at the surface of a core particle provided by a so-called seed polymerization method and polymerizing.

A noncrystalline polyester resin is particularly preferred for the high molecular weight species that forms the shell layer because this supports the prominent manifestation of the above-described effects.

An appropriate selection from saturated polyester resins, unsaturated polyester resins, or both can be used as the noncrystalline polyester resin.

The number average molecular weight (Mn) of the high molecular weight species is preferably from at least 2,500 to not more than 20,000.

In the present invention, the noncrystalline polyester resin-based shell layer has little shielding effect as compared to the shielding performance of the magnetic shell; in addition, since this shell layer lacks a relaxation effect, it is considered to also have little effect with respect to changing the yield value from yield value A to yield value B.

The magnetic toner of the present invention contains an inorganic fine powder as an external additive. This inorganic fine powder can be specifically exemplified by fine silica powder such as wet silica and dry silica, fine titanium oxide powder, and fine alumina powder; fine treated powders as provided by executing a surface treatment on the preceding using a silane compound, titanium coupling agent, or silicone oil; oxides such as zinc oxide and tin oxide; composite oxides such as strontium titanate, barium titanate, calcium titanate, strontium zirconate, and calcium zirconate; and carbonate salt compounds such as calcium carbonate and magnesium carbonate.

The number-average primary particle diameter (D1) of the inorganic fine powder is preferably from at least 4 to not more than 80 nm and is more preferably from at least 6 to not more than 40 nm. The inorganic fine powder is added in order to improve toner flowability and provide uniform toner charging, but in a preferred embodiment also exhibits, through a hydrophobic treatment of the inorganic fine powder, functions such as adjusting the amount of toner charge and improving the environmental stability.

The amount of use of the inorganic fine powder is preferably from at least 0.01 to not more than 10 mass parts per 100 mass parts of the toner particles and more preferably is from at least 0.1 to not more than 5 mass parts per 100 mass parts of the toner particles.

The weight-average particle diameter (D4) of the magnetic toner of the present invention is preferably from at least 3.0 to not more than 12.0 μm and more preferably is from at least 4.0 to not more than 10.0 μm. An excellent flowability and a uniform charge are obtained when the weight-average particle diameter (D4) is from at least 3.0 to not more than 12.0 μm.

The methods for measuring the properties related to the magnetic toner of the present invention are described below.

<Measurement of Stress Relaxation on the Toner>

An ARES rotating plate rheometer (trade name, from TA Instruments) is used as the measurement instrument.

The measurement sample is a plate-shaped sample with a length of 15±2 mm, width of 10±1 mm, and thickness of 2.5±0.3 mm and is produced by compression molding the magnetic toner at 25° C. using a molder.

This plate-shaped sample is mounted in the Torsion Rectangular of the above-described instrument and set so the initial normal force becomes 0 and the measurement is begun.

The measurement is run using the following conditions.

(1) The initial applied strain (Strain) value is set to 0.1% and Points Per Zone=200 and Zone Time=100 are set.

(2) The measurement mode (Sample Geometry) is set to the following condition.

Geometry: Torsion Rectangular Geometry (3) The measurement conditions (Test Setup) are set as follows.

Test Setup: Stress Relaxation Test (stress relaxation measurement mode)

Test Type: Strain-controlled (strain controlled)

Measurement Type: Transient

Yield values A and B for the toner were calculated using a master curve constructed based on the time-temperature superposition principle. Specifically, stress relaxation curves are first obtained by measuring the storage elastic modulus G' at 5° C. intervals in the temperature range from 25 to 80° C. A master curve of the obtained stress relaxation curves was constructed using the following method and using 25° C. for the reference temperature.

The data selection screen (Select Data to Shift) is opened on the analysis software (TA Orchestrator); the data from 25 to 80° C. is selected; and the reference temperature is selected (Reference Experiment Set). The master curve is then drawn (Create TTS, TTS Overlay Curve, Shift All Data Sets). The inflection point is determined from the obtained master curve, and the value at that point is made the yield value (sec).

To measure the yield value A, the stress relaxation curves were first obtained as above in 5° C. increments from 25 to 80° C. Using 25° C. as the reference, the master curve was constructed from the stress relaxation curves obtained at the individual temperatures. The yield value A of the magnetic toner was determined from this master curve.

To measure the yield value B, on the other hand, the measurement at 80° C. for yield value A was followed by cooling the measurement atmosphere from 80 to 25° C. and acquisition of the stress relaxation curves in 5° C. increments from 25 to 80° C. as for the yield value A measurements. Using 25° C. as the reference, the master curve was constructed from the stress relaxation curves obtained at the individual temperatures. The yield value B of the magnetic toner was determined from this master curve.

<Measurement of the Weight-Average Molecular Weight (Mw) and the Radius of Gyration (Rw) Using Size Exclusion Chromatography with a Multiangle Laser Light Scattering (SEC-MALLS)>

0.03 g of the magnetic toner is dispersed and dissolved in 10 mL of tetrahydrofuran (THF) followed by shaking for 24 hours at a temperature of 25° C. using a shaker. Filtration is then performed using a 0.2 μm filter and the THF-soluble fraction of the toner is obtained as the filtrate. The measurement is carried out using this filtrate as the sample and using the following analytical conditions.

<Analytical Conditions> separation column: TSKgel GMHHR-H(20) HT×2 (Tosoh Corporation)

column temperature: 40° C.

mobile phase solvent: tetrahydrofuran mobile phase flow rate: 1.0 mL/min sample concentration: 0.3% injection amount: 300 μL detector 1: multiangle light scattering detector (Wyatt DAWN EOS: Wyatt Technology Corporation)

detector 2: differential refractive index detector (Shodex RI-71: Showa Denko Kabushiki Kaisha)

The weight-average molecular weight (Mw) and radius of gyration (Rw) were determined by analysis of the obtained measurement results with ASTRA for Windows 4.73.04 (Wyatt Technology Corporation) analytical software.

<Measurement of the Dielectric Loss Tangent (tan δ)>

1 g of the magnetic toner is weighed out and subjected to a load of 20 kPa for 1 minute to mold a measurement sample having the shape of a circular disk with a diameter of 25 mm and a thickness of 1.5±0.5 mm.

This measurement sample is mounted in an ARES (TA Instruments) equipped with a dielectric constant measurement fixture (electrodes) having a diameter of 25 mm. The dielectric loss tangent ($\tan \delta = \epsilon''/\epsilon'$) is calculated from the value measured for the complex dielectric constant at a frequency of 10,000 (Hz) using a 4284A Precision LCR meter (Hewlett-Packard) at a measurement temperature of 25° C. with the application of a load of 250 g/cm$^2$.

<Measurement of the Melting Point (Temperature of the Endothermic Peak Top) of the Release Agent>

The melting point (temperature of the endothermic peak top) is measured based on ASTM D3418-82 using a Q1000 differential scanning calorimeter (from TA Instruments). Temperature correction of the instrument detector uses the melting points of indium and zinc, while correction of the amount of heat uses the heat of fusion of indium.

Specifically, approximately 10 mg of the release agent is accurately weighed out and this is introduced into the aluminum pan and the measurement is run at a rate of temperature rise of 10° C./min in a measurement temperature range between 30 and 200° C. using an empty aluminum pan for reference. For the measurement, the temperature is temporarily raised to 200° C., then dropped to 30° C., and then ramped up again. The melting point is taken to be the temperature indicating the endothermic peak top of the highest endothermic peak in the DSC curve in the 30 to 200° C. range in the second temperature ramp-up process.

<Measurement of the BET Specific Surface Area of the Magnetic Body>

The BET specific surface area is measured using a Vacu-Prep 061 degassing instrument (Micromeritics Instrument Corporation) and a Gemini 2375 (Micromeritics Instrument Corporation) BET measurement instrument. The BET specific surface area in the present invention is the value of the BET specific surface area by the multipoint method. The following procedure is specifically carried out.

The mass of the empty sample cell is measured and 2.0 g of the magnetic body is then weighed out and filled into the sample cell. The sample-filled sample cell is placed in the degassing instrument and degassing is performed for 12 hours at room temperature. After degassing is finished, the mass of the sample cell as a whole is measured and the precise mass of the sample is calculated from the difference with the empty sample cell. Empty sample cells are then set in the balance port and analysis port of the BET measurement instrument. A Dewar flask filled with liquid nitrogen is placed in the prescribed position and, using the saturated vapor pressure (P0) measurement command, the P0 is measured. After completion of the P0 measurement, the degassed sample cell is placed in the analysis port; the sample mass and P0 are input; and the measurement is then started with the BET measurement command. The BET specific surface area is subsequently calculated automatically.

<The Weight-Average Particle Diameter (D4) of the Magnetic Toner>

The weight-average particle diameter (D4) of the magnetic toner is measured using the "Coulter Counter Multisizer 3" (registered trademark, from Beckman Coulter, Inc), a precision particle size distribution measurement instrument operating on the pore electrical resistance principle and equipped with a 100 μm aperture tube, and also using the accompanying Beckman Coulter Multisizer 3 Version 3.51 dedicated software (from Beckman Coulter, Inc.) in order to set the measurement conditions and analyze the measurement data. The measurements are carried at 25,000 channels for the number of effective measurement channels and the measurement data is analyzed and the calculations are performed. The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software is configured as follows prior to measurement and analysis.

In the "screen for modifying the standard operating method (SOM)" in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "screen for setting conversion from pulses to particle diameter" of the dedicated software, the bin interval is set to logarithmic particle diameter; the particle diameter bin is set to 256 particle diameter bins; and the particle diameter range is set to 2 to 60 μm.

The specific measurement procedure is as follows.

(1) 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube have previously been removed by the "aperture flush" function of the analysis software.

(2) 30 mL of the above-described aqueous electrolyte solution is introduced into a 100-mL flatbottom glass beaker, and to this is added about 0.3 mL of a dilution prepared by the three-fold (mass) dilution with ion-exchanged water of the dispersant "Contaminon N" (a 10 mass % aqueous solution (pH 7) of a neutral detergent for cleaning precision measurement instrumentation, comprising a nonionic surfactant, anionic surfactant, and organic builder, from Wako Pure Chemical Industries, Ltd.).

(3) A prescribed amount of ion-exchanged water is introduced into the water tank of an "Ultrasonic Dispersion System Tetora 150" (ultrasound disperser from Nikkaki Bios Co., Ltd., electrical output=120 W, equipped with two oscillators (oscillation frequency=50 kHz) disposed such that the phases are displaced by 180°), and approximately 2 mL of Contaminon N is added to this water tank.

(4) The beaker described in (2) is set into the beaker holder opening on the ultrasound disperser and the ultrasound disperser is started. The height of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, 10 mg toner is added to the aqueous electrolyte solution in small aliquots and dispersion is carried out. The ultrasound dispersion treatment is continued for an additional 60 seconds. The water temperature in the water bath is controlled as appropriate during ultrasound dispersion to be at least 10 and no more than 40° C.

(6) Using a pipette, the dispersed toner-containing aqueous electrolyte solution prepared in (5) is dripped into the roundbottom beaker set in the sample stand as described in (1) with adjustment to provide a measurement concentration of about 5%. Measurement is then performed until the number of measured particles reaches 50,000.

(7) The measurement data is analyzed by the above-described dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Method of Measuring the Hydrolysis Proportion of the Silane Compound>

The hydrolysis proportion of the silane compound will now be described. When an alkoxysilane is subjected to a hydrolysis treatment, a mixture of the hydrolyzate, unhydrolyzed material, and condensate is obtained. The proportion of the hydrolyzate in the obtained mixture is described below. This mixture corresponds to the silane compound described above.

Figure 2:
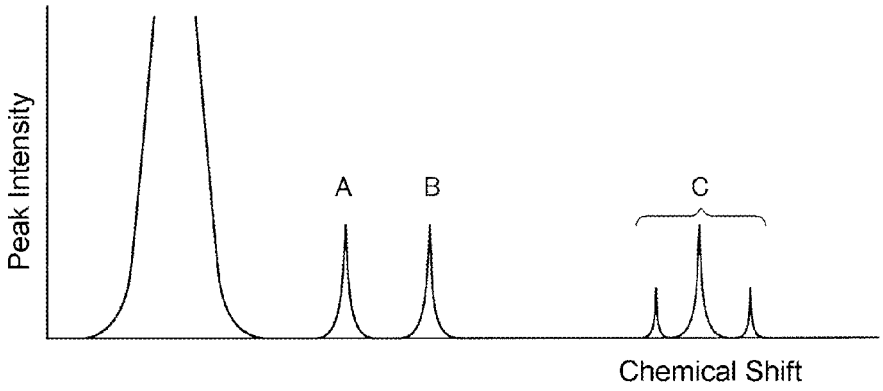
FIG. 2 is a schematic diagram of a model $^1$H-NMR of a silane compound (measurement results for a silane compound).

The hydrolysis reaction of the alkoxysilane will first be described using the example of methoxysilane. When methoxysilane is hydrolyzed, the methoxy group becomes the hydroxyl group and methanol is produced. Accordingly, the degree of advance of the hydrolysis can be assessed from the amount ratio between the methoxy group and methanol. The hydrolysis proportion was determined in the present invention by measurement of this amount ratio by $^1$H-NMR (nuclear magnetic resonance). A model diagram is shown in FIG. 2. In FIG. 2, A represents a peak originating with the alkyl moiety of the alkoxy group; B represents a peak originating with the alkyl moiety of the alkyl alcohol; and C represents a peak originating with the alkyl group of the alkylalkoxysilane. The specific measurement method and calculation method is given below for the example of methoxysilane.

The $^1$H-NMR (nuclear magnetic resonance) of methoxysilane was first measured in deuterated chloroform prior to execution of the hydrolysis treatment and the peak position originating with the methoxy group was identified. After this, the hydrolysis treatment was run on the methoxysilane to make a silane compound, and the hydrolysis reaction was stopped by bringing the aqueous silane compound solution immediately before addition to the untreated magnetic body to pH 7.0 and a temperature of 10° C. The water in the obtained aqueous solution was removed and a dry silane compound material was obtained. A small amount of deuterated chloroform was added to this dry material and the $^1$H-NMR was measured. The peak originating with the methoxy group in the resulting spectrum was determined based on the previously identified peak position. Designating A as the area of the peak originating with the methoxy group and B as the area of the peak originating with the methyl group of methanol, the hydrolysis proportion was determined using the following equation.

$$\text{hydrolysis proportion (\%)}=B/(A+B)\times 100$$

The $^1$H-NMR measurement conditions were set as follows.

measurement instrument: JNM-EX400 FT-NMR instrument (JEOL Ltd.)
measurement frequency: 400 MHz
pulse condition: 5.0 μs
frequency range: 10500 Hz
number of integrations: 1024 times
measurement temperature: 40° C.

<Measurement of the Polymerization Conversion>

The polymerization conversion in the suspension polymerization method is calculated by quantitating the residual styrene monomer. Thus, the polymerization conversion is taken to be 0% when the total amount of the added styrene monomer is detected in its entirety in the measurement described below, while the polymerization conversion is taken to be 100% when styrene monomer is not detected in the toner due to the development of the polymerization reaction.

To quantitate the residual styrene monomer in the toner, measurement is performed as described below by gas chromatography (GC).

500 mg of accurately weighed toner is introduced into a sample bottle. 10 g of accurately weighed acetone is added to this; the cap is applied; thorough mixing is performed; and exposure to ultrasound is carried out for 30 minutes using a desktop ultrasonic cleaner having an electrical output of 125 W and an oscillation frequency of 42 kHz (for example, a B2510J-MTH (trade name) from Branson Ultrasonics Corporation). After this, filtration is carried out using a MyShoriDisk solvent-resistant membrane filter having a pore diameter of 0.2 μm (Tosoh Corporation) and 2 μL of the filtrate is analyzed by gas chromatography. The residual amount of residual styrene monomer is calculated using a calibration curve constructed in advance using styrene.

The measurement instrument and measurement conditions are as following.

GC: 6890GC from Hewlett-Packard
column: INNOWax (200 μm×0.40 μm×25 m) from Hewlett-Packard
carrier gas: He (constant pressure mode: 20 psi)
oven: (1) hold 10 minutes at 50° C.
(2) increase to 200° C. at 10° C./min
(3) hold 5 minutes at 200° C.
injection port: 200° C., pulsed splitless mode (20→40 psi, until 0.5 min)
split ratio: 5.0:1.0
detector: 250° C. (FID)

EXAMPLES

The invention is described more specifically below through production examples and examples. Below, the number of parts of incorporation in all instances refers to mass parts.

<Production of Untreated Magnetic Body 1>

An aqueous solution containing ferrous hydroxide was produced by mixing at least 1.0 but not more than 1.1 equivalents, with reference to the iron, of a sodium hydroxide solution and 1.5 mass % sodium silicate, as silicon with reference to the iron, into an aqueous ferrous sulfate solution.

While holding the obtained aqueous solution at pH 9.0, air was bubbled in and an oxidation reaction was run at from at least 80° C. to not more than 90° C. to produce a slurry in which seed crystals had been produced. To this slurry was then added an aqueous ferrous sulfate solution so as to provide 1.0 equivalent with reference to the initial amount of base (the sodium component in the sodium hydroxide). After this, the oxidation reaction was developed while bubbling in air and maintaining the slurry at pH 8.0 to obtain a slurry that contained magnetic iron oxide. This slurry was filtered and washed and then deagglomerated and dried to yield an untreated magnetic body 1. The BET specific surface area of the obtained untreated magnetic body 1 was 7.1 $m^2$/g.

<Production of Silane Compound 1>

10 mass parts of isobutyltrimethoxysilane was added dropwise while stirring to 80 mass parts of ion-exchanged water. After this, the obtained aqueous solution was held at pH 5.5 and a temperature of 50° C. and hydrolysis was performed by dispersing for 60 minutes at 0.46 m/s using a disperser blade, thus yielding silane compound 1, which was an aqueous solution containing a hydrolyzate. Measurement of the properties of this silane compound 1 gave a hydrolysis proportion of 90%. The properties of the obtained silane compound 1 are given in Table 1.

<Production of Silane Compounds 2 to 4>

Silane compounds 2 to 4 were obtained as for the production of silane compound 1, but using the alkylalkoxysilanes indicated in Table 1 and adjusting to a hydrolysis time and temperature that gave the desired value for the hydrolysis proportion. The properties of the obtained silane compounds 2 to 4 are given in Table 1.

<Production of Silane Compound 5>

Hydrolysis was not performed on the alkylalkoxysilane indicated in Table 1. The properties of the obtained silane compound 5 are given in Table 1.

TABLE 1

| silane compound | alkylalkoxysilane | temperature (° C.) | time (min) | hydrolysis proportion (%) |
|---|---|---|---|---|
| silane compound 1 | isobutyltrimethoxysilane | 50 | 60 | 90 |
| silane compound 2 | n-propyltrimethoxysilane | 40 | 60 | 90 |
| silane compound 3 | n-hexyltrimethoxysilane | 60 | 60 | 90 |
| silane compound 4 | n-propyltrimethoxysilane | 50 | 90 | 100 |
| silane compound 5 | n-propyltrimethoxysilane | — | — | 0 |

<Production of Treated Magnetic Body 1>

100 mass parts of untreated magnetic body 1 was introduced into a Henschel mixer (Mitsui Miike Engineering Corporation: FM-10C) and 4.5 mass parts of silane compound 1 was added by spraying while dispersion was carried out at a peripheral velocity of 34.5 m/s. After dispersing for 10 minutes in this state, a magnetic body on which silane compound 1 was adsorbed was removed and was deagglomerated with a pin mill, after which the condensation reaction of the silane compound was developed in combination with drying of the treated magnetic body by standing at quiescence for 1 hour at 70° C. and additionally for 3 hours at 150° C. After this, a treated magnetic body 1 having a volume-average particle diameter of 0.24 μm and passing a sieve with an aperture of 100 μm was obtained. Measurement of the BET specific surface area of this treated magnetic body 1 gave 5.8 $m^2/g$. The properties of the obtained treated magnetic body 1 are given in Table 2.

<Production of Treated Magnetic Body 2 to 4, and 9>

Treated magnetic body 2 to 4, and 9 were obtained proceeding as in the production of treated magnetic body 1, but changing, as shown in Table 2, the silane compound, amount of silane compound addition, deagglomeration prior to the heat treatment, and stagewise adjustment of the heat treatment temperature in the production of treated magnetic body 1. The properties of the obtained treated magnetic body 2 to 4, and 9 are shown in Table 2.

<Production of Treated Magnetic Body 5>

Treated magnetic body 5 was produced proceeding as in the production of treated magnetic body 1, but in this case changing the production of treated magnetic body 1 as follows: silane compound 3 was used, and a process of adding 1.0 mass part and dispersing for 10 minutes was carried out 4 times for a total addition of 4.0 mass parts. The properties of the obtained treated magnetic body 5 are shown in Table 2.

<Production of Treated Magnetic Body 6>

100 mass parts of untreated magnetic body 1 was reslurried in a 95% ethanol solution. After this, 4.5 mass parts of silane compound 1 per 100 mass parts of untreated magnetic body 1 was added while stirring. Stirring was then continued for 10 hours to carry out the surface treatment. The obtained treated magnetic body was filtered with a filter press and washed with a large amount of water and then predried for 3 hours at 50° C. and further dried for 1 hour at 70° C. and 3 hours at 150° C. The obtained treated magnetic body particles were deagglomerated and a treated magnetic body 6 having a volume-average particle diameter of 0.24 μm and passing a sieve with an aperture of 100 μm was obtained. The properties of the obtained treated magnetic body 6 are given in Table 2.

<Production of Treated Magnetic Body 7>

Untreated magnetic body 1 was reslurried in water. An aqueous ferrous sulfate solution was then added so as to provide 1.0 equivalent with respect to the initial amount of base (sodium component in the sodium hydroxide) in this slurry. After this, the oxidation reaction was developed while bubbling in air and maintaining the slurry at pH 8.0 to obtain a slurry that contained magnetic iron oxide. While stirring, silane compound 1 was added at 3 mass parts per 100 mass parts of the magnetic iron oxide (the amount of magnetic iron oxide was calculated as the value provided by subtracting the water content from a water-containing sample). Dispersion was carried out with a pin mill while circulating the slurry and thoroughly stirring; the pH of the dispersion was brought to 8.6; and a surface treatment was run for 10 hours. In order to further increase the hydrophobicity of the magnetic body, an additional 1.5 mass parts of silane compound 1 was added per 100 mass parts of the magnetic iron oxide; the pH of the dispersion was brought to 8.6; and a surface treatment was performed for an additional 10 hours.

The produced hydrophobic magnetic body was filtered on a filter press and washed with a large amount of water and then predried for 3 hours at 50° C. and further dried for 1 hour at 70° C. and 3 hours at 150° C. The obtained treated magnetic body particles were deagglomerated and a treated magnetic body 7 having a volume-average particle diameter of 0.24 μm and passing a sieve with an aperture of 100 μm was obtained. The properties of the obtained treated magnetic body 7 are given in Table 2.

<Production of Treated Magnetic Body 8>

Treated magnetic body 8 was produced proceeding as in the production of treated magnetic body 1, but in this case changing the production of treated magnetic body 1 as follows: silane compound 3 was used, and a process of adding 2.0 mass parts and dispersing for 10 minutes was carried out 2 times for a total addition of 4.0 mass parts. The properties of the obtained treated magnetic body 8 are shown in Table 2.

<Production of Comparative Magnetic Body 1>

Untreated magnetic body 1 was used as comparative magnetic body 1. The properties of comparative magnetic body 1 are shown in Table 2.

<Production of Comparative Magnetic Body 2>

Comparative magnetic body 2 was produced proceeding as in the production of treated magnetic body 1, but in this case changing the production of treated magnetic body 1 as follows: silane compound 5 was used; the deagglomeration prior to the heat treatment was omitted; and the heat treatment step was carried out in 1 stage. The properties of the obtained comparative magnetic body 2 are shown in Table 2.

<Production of Comparative Magnetic Body 3>

An aqueous solution containing ferrous hydroxide was produced by mixing at least 1.0 but not more than 1.1 equivalents, with reference to the iron, of a sodium hydroxide solution (contained sodium hexametaphosphate at 1 mass % as phosphorus with reference to the iron) into an aqueous ferrous sulfate solution.

While holding the obtained aqueous solution at pH 9.0, air was bubbled in and an oxidation reaction was run at from at least 80° C. to not more than 90° C. to produce a slurry in which seed crystals had been produced.

To this slurry was then added an aqueous ferrous sulfate solution so as to provide at least 0.9 but no more than 1.2 equivalents with reference to the initial amount of base (the sodium component in the sodium hydroxide). After this, the oxidation reaction was developed while bubbling in air and maintaining the slurry at pH 8.0. The pH was adjusted at the end of the oxidation reaction to approximately 6, and 0.6 mass part and 0.9 mass part, in each case per 100 mass parts of the magnetic iron oxide, of n-$C_4H_9Si(OCH_3)_3$ and n-$C_8H_{17}Si(OC_2H_5)_3$ were added as silane coupling agents and thorough stirring was performed. The produced hydrophobic iron oxide particles were washed, filtered, and dried by the usual methods and the aggregated particles were then subjected to a deagglomeration treatment to obtain comparative magnetic body 3. S1 and S2 were not measured on this comparative magnetic body 3 since, as described above, the magnetic body was produced and treatment with the silane compound was run in aqueous solution.

<Production of Comparative Magnetic Body 4>

Comparative magnetic body 4 was obtained by the same method as for comparative magnetic body 3, but in this case 0.6 mass part of n-$C_4H_9Si(OCH_3)_3$ was added as the silane coupling agent per 100 mass parts of the magnetic iron oxide. S1 and S2 were not measured on this comparative magnetic body 4 since, as described above, the magnetic body was produced and treatment with the silane compound was run in aqueous solution.

Magnetic Toner Production Example 1

451 mass parts of a 0.1 M aqueous $Na_3PO_4$ solution was introduced into 720 mass parts of ion-exchanged water and this was heated to 60° C. 67.7 mass parts of a 1.0 M aqueous $CaCl_2$ solution was then added to obtain an aqueous medium that contained a dispersion stabilizer.

| | |
|---|---|
| styrene | 75.0 mass parts |
| n-butyl acrylate | 25.0 mass parts |
| 1,6-hexanediol diacrylate | 0.5 mass part |
| iron complex of a monoazo dye (T-77: Hodogaya Chemical Co., Ltd.) | 1.0 mass part |
| treated magnetic body 1 | 90.0 mass parts |
| saturated polyester resin | 5.0 mass parts |

(saturated polyester resin obtained by a condensation reaction between terephthalic acid and the 2.0 mol adduct of ethylene oxide on bisphenol A; number average molecular weight (Mn) = 5,000, acid value = 12 mg KOH/g, glass-transition temperature (Tg) = 68° C.)

The components listed above were dispersed and mixed to uniformity using an attritor (Mitsui Miike Engineering Corporation) to obtain a polymerizable monomer composition. This polymerizable monomer composition was heated to 60° C. and 15.0 mass parts of behenyl behenate wax (melting point: 73° C.) was mixed and dissolved thereinto followed by the dissolution of 5 mass parts of t-butylperoxy neoheptanoate as polymerization initiator.

TABLE 2

| | untreated magnetic body | silane compound | amount of silane compound addition (mass parts) | treatment environment | deagglomeration prior to heat treatment | heat treatment 1: heat treatment temperature (° C.) | heat treatment 1: heat treatment time (hr) | heat treatment 2: heat treatment temperature (° C.) | heat treatment 2: heat treatment time (hr) | S2 ($m^2/g$) | S1 ($m^2/g$) | S2/S1 |
|---|---|---|---|---|---|---|---|---|---|---|---|---|
| treated magnetic body 1 | untreated magnetic body 1 | silane compound 1 | 4.5 | gas phase | yes | 70 | 1 | 150 | 3 | 5.8 | 7.1 | 0.82 |
| treated magnetic body 2 | untreated magnetic body 1 | silane compound 1 | 4.5 | gas phase | yes | 150 | 4 | — | — | 5.0 | 7.1 | 0.71 |
| treated magnetic body 3 | untreated magnetic body 1 | silane compound 1 | 4.5 | gas phase | No | 150 | 4 | — | — | 4.7 | 7.1 | 0.66 |
| treated magnetic body 4 | untreated magnetic body 1 | silane compound 2 | 6.0 | gas phase | yes | 70 | 1 | 150 | 3 | 5.5 | 7.1 | 0.77 |
| treated magnetic body 5 | untreated magnetic body 1 | silane compound 3 | 4.0 | gas phase | yes | 70 | 1 | 150 | 3 | 5.6 | 7.1 | 0.79 |
| treated magnetic body 6 | untreated magnetic body 1 | silane compound 1 | 4.5 | solvent wet method | yes | 70 | 1 | 150 | 3 | 5.2 | 7.1 | 0.73 |
| treated magnetic body 7 | untreated magnetic body 1 | silane compound 1 | 4.5 | water based wet method | yes | 70 | 1 | 150 | 3 | 5.1 | 7.1 | 0.72 |
| treated magnetic body 8 | untreated magnetic body 1 | silane compound 3 | 4.0 | gas phase | yes | 70 | 1 | 150 | 3 | 5.1 | 7.1 | 0.72 |
| treated magnetic body 9 | untreated magnetic body 1 | silane compound 4 | 6.0 | gas phase | yes | 70 | 1 | 150 | 3 | 5.6 | 7.1 | 0.79 |
| comparative magnetic body 1 | untreated magnetic body 1 | — | — | — | — | — | — | — | — | — | 7.1 | — |
| comparative magnetic body 2 | untreated magnetic body 1 | silane compound 5 | 4.5 | gas phase | No | 150 | 4 | — | — | 4.0 | 7.1 | 0.56 |

The polymerizable monomer composition was introduced into the above-described aqueous medium and granulation was performed by stirring for 10 minutes at 18.8 m/s with a TK Homomixer (Tokushu Kika Kogyo Co., Ltd.) at 60° C. under an $N_2$ atmosphere. This was followed by carrying out a reaction step by stirring with paddle stirring blades at a temperature of 70° C. (a temperature 17° C. higher than the 10-hour half-life temperature of the polymerization initiator).

Then, when the polymerization conversion had reached 50%, a supplemental addition of 1 mass part of the t-butylperoxy neoheptanoate polymerization initiator was made; another supplemental addition of 0.5 part was made at a polymerization conversion of 70%; and the reaction step was completed at a reaction time of 300 minutes.

After completion of the reaction, the suspension was cooled; hydrochloric acid was added and the dispersion stabilizer was dissolved; and filtration, washing with water, and drying were performed to yield magnetic toner particle 1.

100 mass parts of magnetic toner particle 1 was mixed using a Henschel mixer (Mitsui Miike Engineering Corporation) with 1.0 mass part of a hydrophobic fine silica powder that had a post-treatment BET specific surface area of 120 $m^2/g$; this hydrophobic fine silica powder was obtained by treating a silica with a number-average primary particle diameter of 12 nm with hexamethyldisilazane and then with a silicone oil. A magnetic toner 1 with a weight-average particle diameter (D4) of 7.5 μm was obtained as a result. Analysis of the obtained magnetic toner showed that it contained 100 mass parts of a binder resin composed of a styrene-acrylic acid resin. The properties of magnetic toner 1 are shown in Table 4.

<Production of Magnetic Toners 2 to 15 and Comparative Magnetic Toners 2 and 3>

Magnetic toners 2 to 15 and comparative magnetic toners 2 and 3 were obtained proceeding as in the production of magnetic toner 1, but in this case changing, as shown in Tables 3 and 4, the type of release agent, the type of treated magnetic body, and the type and amount of addition of the polymerization initiator in the production of magnetic toner 1. Analysis of these magnetic toners showed that they contained 100 mass parts of a binder resin composed of a styrene-acrylic acid resin. The properties of the obtained magnetic toners 2 to 15 and comparative magnetic toners 2 and 3 are shown in Table 4.

<Production of Comparative Magnetic Toner 1>

| | |
|---|---|
| styrene/2-ethylhexyl acrylate copolymer (88/12 mass ratio) | 100.0 mass parts |
| comparative magnetic body 1 (untreated magnetic body 1) | 90.0 mass parts |
| T-77 (Hodogaya Chemical Co., Ltd.) | 2.0 mass parts |
| release agent 1 | 3.0 mass parts |

The starting materials listed above were mixed for 3 minutes with a Henschel mixer followed by melt mixing/kneading with a PCM-30 twin-screw extruder heated to 150° C. After cooling with a cooling belt (15° C. cooling water), the mixture was coarsely pulverized with a hammer mill. This coarsely pulverized material was micropulverized with a Turbo Mill (Turbo Kogyo Co., Ltd.) and the obtained micropulverized material was classified with a pneumatic classifier to yield comparative magnetic toner particle 1.

100 mass parts of comparative magnetic toner particle 1 was mixed using a Henschel mixer (Mitsui Miike Engineering Corporation) with 1.0 mass part of a hydrophobic fine silica powder that had a post-treatment BET specific surface area of 120 $m^2/g$; this hydrophobic fine silica powder was obtained by treating a silica with a number-average primary particle diameter of 12 nm with hexamethyldisilazane and then with a silicone oil. A comparative magnetic toner 1 with a weight-average particle diameter (D4) of 7.5 μm was obtained as a result. The properties of the obtained comparative magnetic toner 1 are shown in Table 4.

<Production of Comparative Magnetic Toner 4>

451.0 parts of a 0.1 mol/L aqueous $Na_3PO_4$ solution was introduced into 709.0 mass parts of ion-exchanged water and this was heated to 60° C. 67.7 mass parts of a 1.0 mol/L aqueous $CaCl_2$ solution was then gradually added to obtain an aqueous medium that contained $Ca_3(PO_4)_2$.

The following formulations were dispersed/mixed to uniformity using an attritor (Mitsui Miike Engineering Corporation).

| | |
|---|---|
| styrene | 74.0 mass parts |
| n-butyl acrylate | 26.0 mass parts |
| saturated polyester resin (monomer composition: propylene oxide adduct on bisphenol A/terephthalic acid/isophthalic acid, acid value: 12 mg KOH/g, Tg: 69° C., Mn: 4200, Mw: 11000) | 3.0 mass parts |
| negative charge control agent (T-77: Fe compound of a monoazo dye system, from Hodogaya Chemical Co., Ltd.) | 2.0 mass parts |
| comparative magnetic body 3 | 90.0 mass parts |

Comparative magnetic body 3 was deagglomerated with a ball mill as a pretreatment prior to mixing with the other materials. In addition, during dispersion and mixing, the value of C/E, i.e., the ratio of the average rate of introduction C (kg/s) of the comparative magnetic body 3 versus the mass E (kg) of the polymerizable monomer, was controlled to an average of $2.7\times10^{-4}$.

The mixture of the preceding was heated to 60° C.; 10.0 mass parts of a hydrocarbon wax (C105 (Sasol Ltd.), endothermic main peak temperature by DSC: 105° C.) was mixed and dissolved thereinto; and 2.0 mass parts of butyl peroxide was dissolved as a polymerization initiator to yield a polymerizable monomer composition.

This polymerizable monomer composition was introduced into the above-described aqueous medium and granulation was carried out by stirring for 15 minutes at 12,000 rpm with a Clearmix (M Technique Co., Ltd.) at 60° C. under an $N_2$ atmosphere. Then, while stirring with a paddle stirring blade, a reaction was run for 1 hour at 80° C. This was followed by bringing the liquid temperature to 80° C. and continuing to stir for an additional 10 hours. After completion of the reaction, the suspension was cooled; hydrochloric acid was added and the $Ca_3(PO_4)_2$ was dissolved; and filtration, washing with water, and drying were performed to obtain comparative magnetic toner particle 4.

100 mass parts of this comparative magnetic toner particle 4 was mixed with a Henschel mixer (Mitsui Miike Engineering Corporation) with 1.2 mass parts of a hydrophobic fine silica powder that had a post-treatment BET specific surface area of 140 $m^2/g$ (this hydrophobic fine silica powder was obtained by treatment with hexamethyldisilazane and then with a silicone oil) to obtain comparative magnetic toner 4 (weight-average particle diameter=6.5 μm). The properties of the obtained comparative magnetic toner 4 are shown in Table 4.

<Production of Comparative Magnetic Toner 5>

451 mass parts of a 0.1 mol/L aqueous $Na_3PO_4$ solution was introduced into 709 mass parts of ion-exchanged water and this was heated to 60° C. 67.7 mass parts of a 1.0 mol/L aqueous $CaCl_2$ solution was then gradually added to obtain a pH=8.5 aqueous medium that contained $Ca_3(PO_4)_2$.

The following formulations were dispersed/mixed to uniformity using an attritor (Mitsui Miike Engineering Corporation).

| | |
|---|---|
| styrene | 78.0 mass parts |
| n-butyl acrylate | 22.0 mass parts |
| saturated polyester resin (polycondensate of isophthalic acid and propylene oxide-modified bisphenol A, acid value = 8 mg KOH/g, Mn = 6000, Mw = 10000, Tg = 65° C.) | 5.0 mass parts |
| negative charge control agent (T-77: Fe compound of a monoazo dye system, from Hodogaya Chemical Co., Ltd.) | 2.0 mass parts |
| comparative magnetic body 4 (contained 0.48 mass part of a coupling agent) | 80.0 mass parts |
| polar compound | 0.1 mass part |

chemical formula 1

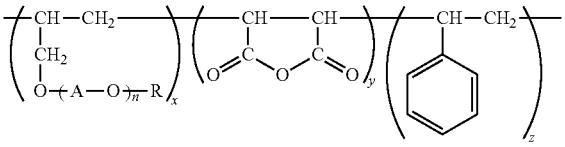

(in the preceding formula, n = 9, A = —$CH_2CH_2$—, R = methyl group, compound (random copolymer) with x:y:z = 50:40:10, saponification value = 150, peak molecular weight (Mp) = 3,000)

This monomer composition was heated to 60° C.; 15 parts of an ester wax (behenyl behenate, endothermic main peak temperature by DSC: 70° C.) was mixed and dissolved thereinto; and 2.0 mass parts of butyl peroxide was dissolved as a polymerization initiator to yield a polymerizable monomer composition. This polymerizable monomer composition was introduced into the above-described aqueous medium and granulation was carried out by stirring for 15 minutes at 10,000 rpm with a TK Homomixer (Tokushu Kika Kogyo Co., Ltd.) at 60° C. under an $N_2$ atmosphere. Then, while stirring with a paddle stirring blade, a reaction was run for 1 hour at 80° C. This was followed by bringing the liquid temperature to 80° C. and continuing to stir for an additional 10 hours. After completion of the reaction, the suspension was cooled; hydrochloric acid was added and the $Ca_3(PO_4)_2$ was dissolved; and filtration, washing with water, and drying were performed to obtain comparative magnetic toner particle 5.

100 mass parts of this comparative magnetic toner particle 5 was mixed with a Henschel mixer (Mitsui Miike Engineering Corporation) with 1.4 mass parts of a hydrophobic fine silica powder that had a post-treatment BET specific surface area of 120 $m^2/g$ (this hydrophobic fine silica powder was obtained by treatment with hexamethyldisilazane and then with a silicone oil) to obtain comparative magnetic toner 5 (weight-average particle diameter=5.4 μm). The properties of the obtained comparative magnetic toner 5 are shown in Table 4.

TABLE 3

| | Name | melting point (° C.) |
|---|---|---|
| release agent 1 | behenyl behenate | 73 |
| release agent 2 | paraffin wax | 77 |
| release agent 3 | carnauba wax | 83 |

TABLE 4

| | Magnetic Body | polymerization initiator | initial amount of addition (mass parts) | supplemental amount of addition-1 (mass parts) | supplemental amount of addition-2 (mass parts) | release agent | yield value A (sec) | yield value B (sec) | Mw | Rw/Mw | tanδ |
|---|---|---|---|---|---|---|---|---|---|---|---|
| Magenetic Toner 1 | treated magnetic body 1 | t-butylperoxy neoheptanoate | 5.0 | 1.0 | 0.5 | release agent 1 | $6 \times 10^6$ | $5 \times 10^4$ | 13200 | $3.5 \times 10^{-3}$ | $1.8 \times 10^{-2}$ |
| Magenetic Toner 2 | treated magnetic body 2 | t-butylperoxy neoheptanoate | 5.0 | 1.0 | 0.5 | release agent 1 | $5 \times 10^6$ | $4 \times 10^4$ | 13200 | $3.5 \times 10^{-3}$ | $1.6 \times 10^{-2}$ |
| Magenetic Toner 3 | treated magnetic body 3 | t-butylperoxy neoheptanoate | 5.0 | 1.0 | 0.5 | release agent 1 | $4 \times 10^6$ | $3 \times 10^4$ | 13200 | $3.5 \times 10^{-3}$ | $1.4 \times 10^{-2}$ |
| Magenetic Toner 4 | treated magnetic body 4 | t-butylperoxy neoheptanoate | 5.0 | 1.0 | 0.5 | release agent 1 | $7 \times 10^6$ | $6 \times 10^4$ | 13200 | $3.5 \times 10^{-3}$ | $2.4 \times 10^{-2}$ |
| Magenetic Toner 5 | treated magnetic body 5 | t-butylperoxy neoheptanoate | 5.0 | 1.0 | 0.5 | release agent 1 | $4 \times 10^6$ | $4 \times 10^4$ | 13200 | $3.5 \times 10^{-3}$ | $1.0 \times 10^{-2}$ |
| Magenetic Toner 6 | treated magnetic body 6 | t-butylperoxy neoheptanoate | 5.0 | 1.0 | 0.5 | release agent 1 | $6 \times 10^6$ | $5 \times 10^4$ | 13200 | $3.5 \times 10^{-3}$ | $1.7 \times 10^{-2}$ |
| Magenetic Toner 7 | treated magnetic body 7 | t-butylperoxy neoheptanoate | 5.0 | 1.0 | 0.5 | release agent 1 | $5 \times 10^6$ | $5 \times 10^4$ | 13200 | $3.5 \times 10^{-3}$ | $1.3 \times 10^{-2}$ |
| Magenetic Toner 8 | treated magnetic body 1 | t-butylperoxy neoheptanoate | 5.0 | 1.0 | 0.5 | release agent 2 | $6 \times 10^6$ | $5 \times 10^4$ | 13200 | $3.5 \times 10^{-3}$ | $1.8 \times 10^{-2}$ |
| Magenetic Toner 9 | treated magnetic body 1 | t-butylperoxy neoheptanoate | 5.0 | 1.0 | 0.5 | release agent 3 | $6 \times 10^6$ | $9 \times 10^4$ | 13200 | $3.5 \times 10^{-3}$ | $1.8 \times 10^{-2}$ |

TABLE 4-continued

| | Magnetic Body | polymerization initiator | initial amount of addition (mass parts) | supple-mental amount of addition-1 (mass parts) | supple-mental amount of addition-2 (mass parts) | release agent | yield value A (sec) | yield value B (sec) | Mw | Rw/Mw | tanδ |
|---|---|---|---|---|---|---|---|---|---|---|---|
| Magenetic Toner 10 | treated magnetic body 8 | t-butylperoxy neoheptanoate | 5.0 | 1.0 | 0.5 | release agent 1 | $3 \times 10^6$ | $5 \times 10^4$ | 13200 | $3.5 \times 10^{-3}$ | $9.0 \times 10^{-3}$ |
| Magenetic Toner 11 | treated magnetic body 9 | t-butylperoxy neoheptanoate | 5.0 | 1.0 | 0.5 | release agent 1 | $8 \times 10^6$ | $5 \times 10^4$ | 13200 | $3.5 \times 10^{-3}$ | $2.6 \times 10^{-2}$ |
| Magenetic Toner 12 | treated magnetic body 1 | t-butylperoxy neoheptanoate | 10.0 | 2.0 | 1.0 | release agent 1 | $3 \times 10^6$ | $1 \times 0^4$ | 6000 | $6.8 \times 10^{-3}$ | $1.8 \times 10^{-2}$ |
| Magenetic Toner 13 | treated magnetic body 1 | t-butylperoxy neoheptanoate | 4.0 | 1.0 | 0.5 | release agent 1 | $6 \times 10^6$ | $9 \times 10^4$ | 24000 | $2.0 \times 10^{-3}$ | $1.8 \times 10^{-2}$ |
| Magenetic Toner 14 | treated magnetic body 1 | t-butylperoxy neoheptanoate | 12.0 | 3.0 | 1.0 | release agent 1 | $3 \times 10^6$ | $1 \times 10^4$ | 4400 | $9.1 \times 10^{-3}$ | $1.8 \times 10^{-2}$ |
| Magenetic Toner 15 | treated magnetic body 1 | t-butylperoxy neoheptanoate | 3.0 | 1.0 | 0.5 | release agent 1 | $8 \times 10^6$ | $9 \times 10^4$ | 26000 | $1.9 \times 10^{-3}$ | $1.8 \times 10^{-2}$ |
| Comparative Magenetic Toner 1 | comparative treated magnetic body 1 | — | — | — | — | release agent 1 | $9 \times 10^5$ | $2 \times 10^5$ | 60000 | $6.7 \times 10^{-4}$ | $5.0 \times 10^{-3}$ |
| Comparative Magenetic Toner 2 | comparative treated magnetic body 2 | 2,2-azobis (2,4-dimethylvaleronitrile) | 4.5 | — | — | release agent 1 | $2 \times 10^6$ | $9 \times 10^3$ | 100000 | $3.9 \times 10^{-4}$ | $5.0 \times 10^{-3}$ |
| Comparative Magenetic Toner 3 | comparative treated magnetic body 2 | 2,2-azobis (2,4-dimethylvaleronitrile) | 2.2 | — | — | release agent 1 | $1 \times 10^7$ | $2 \times 10^6$ | 120000 | $4.2 \times 10^{-4}$ | $5.5 \times 10^{-3}$ |
| Comparative Magenetic Toner 4 | comparative treated magnetic body 3 | butyl peroxide | 2.0 | — | — | hydro-carbon wax | $1 \times 10^5$ | $2 \times 10^4$ | 130000 | $3.8 \times 10^{-4}$ | $4.8 \times 10^{-3}$ |
| Comparative Magenetic Toner 5 | comparative treated magnetic body 4 | butyl peroxide | 2.0 | — | — | behenyl behenate | $1 \times 10^5$ | $8 \times 10^3$ | 134000 | $3.6 \times 10^{-4}$ | $6.3 \times 10^{-3}$ |

Example 1

The following evaluations were performed using magnetic toner 1.

Evaluations were performed in the present invention after standing under a severe environment presuming an acceleration of toner deterioration when held long-term under an environment more severe than normal, for example, storage in a warehouse.

The following evaluations of the dot reproducibility, image density, fogging, and low-temperature fixability used a magnetic toner 1 that had been held for 7 days under a high temperature and high humidity of temperature=45° C. and humidity=90%.

<Evaluation of the Dot Reproducibility>

An LBP-3410 laser printer from Canon was modified to bring the process speed from 210 to 315 mm/sec. With regard to the evaluation environment, image evaluation was performed under a high temperature and high humidity of temperature=32.5° C. and humidity=85%. An initial dot reproducibility evaluation was performed and the dot reproducibility was also evaluated post-durability testing.

The first image was evaluated for the initial evaluation. With regard to the image evaluation post-durability testing, after evaluation of the image density post-durability testing, infra, this was carried out, after standing for an additional day, under conditions unfavorable for charging.

For the image evaluation in regard to the dot reproducibility, output image testing was carried out using the 80×50 μm checkerboard pattern shown in FIG. 1. The evaluation was performed by microscopically surveying for the presence/absence of defects in the black areas.

For comparison, the initial evaluation was also performed using the magnetic toner that had not been subjected to the holding for 7 days under a high temperature and high humidity of temperature=45° C. and humidity=90%.

(Evaluation Scale)

A: not more than 2 defects/100

B: 3 to 5 defects/100

C: 6 to 10 defects/100

D: 11 or more defects/100

<Image Density Post-Durability Testing>

An LBP-3410 laser printer from Canon was modified to bring the process speed from 210 to 315 mm/sec. With regard to the evaluation environment, image evaluation was performed under a high temperature and high humidity of temperature=32.5° C. and humidity=85%. For the evaluation, 6000 prints were output in continuous mode of horizontal lines having a print percentage of 4%, and the solid black density after this was used as the image density post-durability testing. For the evaluation of the initial image density, the evaluation was performed on the second solid black image after output of the image for the evaluation of the dot reproducibility.

For comparison, the initial image density was evaluated also in the absence of the holding under a high temperature and high humidity of temperature=45° C. and humidity=90%. For the image density, the relative density was measured using a MacBeth Reflection Densitometer (MacBeth) with respect to the printed out image of the white background region where the original had a density of 0.00. The following scale was used for the evaluation.

A: the image density was at least 1.45

B: the image density was at least 1.35 but less than 1.45

C: the image density was at least 1.25 but less than 1.35

D: the image density was less than 1.25

<Fogging>

Image evaluation was performed using a commercially available LBP3410 laser printer (Canon). To perform the evaluation, 6000 prints were output in continuous mode of horizontal lines with a print percentage of 4%; the machine was then transferred to a low temperature low humidity environment (15.0° C., 10% RH) and held for 1 day; and a solid white image was then output and the evaluation was performed.

To measure the fogging, the reflectance of a reference paper and the non-image area of the printed out image was measured using a Model TC-6DS Reflectometer reflection densitometer from Tokyo Denshoku Co., Ltd. A green filter was used for the filter. The fogging was calculated using the following equation from the reflectance before white image output and the reflectance after white image output. The fogging was evaluated according to the following scale using the maximum value of the obtained fogging values.

fogging (reflectance) (%)=reflectance (%) of the reference paper−reflectance (%) of the white image sample A: fogging (reflectance) not more than 1.0%

B: fogging (reflectance) greater than 1.0% but not more than 1.5%

C: fogging (reflectance) greater than 1.5% but not more than 2.0%

D: fogging (reflectance) greater than 2.0%

<Low-Temperature Fixability>

An LBP3410 laser printer from Canon was modified to enable the fixing temperature of the fixing apparatus to be freely selectable. A halftone image providing an image density of from 0.75 to 0.80 was formed on Fox River Bond paper in a normal temperature and normal humidity (23° C., 60% RH) environment, and the image was fixed with the temperature of the fixing unit being raised in 5° C. increments from 140° C. The fixed image was then rubbed 10 times with lens-cleaning paper to which a weight of 55 g/cm$^2$ was applied, and the temperature at which the density of the fixed image after rubbing exhibited a decline of 15% was taken to be the initial fixing temperature. Lower values for this temperature are indicative of a toner that exhibits a better low-temperature fixability.

<Evaluation Scale>

A: the initial fixing temperature was at least 140° C. but less than 150° C.

B: the initial fixing temperature was at least 150° C. but less than 160° C.

C: the initial fixing temperature was at least 160° C. but less than 170° C.

D: the initial fixing temperature was 170° C. or more

In the above-described evaluations, magnetic toner 1 exhibited excellent effects for all of the items evaluated.

Examples 2 to 15

The same evaluations as in Example 1 were performed on magnetic toner 2 to magnetic toner 15 and the results are given in Table 5.

Comparative Examples 1 to 5

The same evaluations as in Example 1 were performed on comparative magnetic toners 1 to 5 and the results are given in Table 5.

TABLE 5

| | | before holding, high temperature high humidity environment initial developing performance | | after holding, high temperature high humidity environment initial developing performance | | after holding, high temperature high humidity environment developing performance post-durability testing | | low-temperature fixability | under a low temperature low humidity environment |
|---|---|---|---|---|---|---|---|---|---|
| Example | Toner | dot reproducibility (number) | density | dot reproducibility (number) | density | dot reproducibility (number) | density | (° C.) | fogging |
| Example 1 | Magnetic Toner 1 | A(0) | A(1.54) | A(0) | A(1.52) | A(1) | A(1.49) | A(148) | A(0.5) |
| Example 2 | Magnetic Toner 2 | A(0) | A(1.53) | A(1) | A(1.51) | A(2) | A(1.49) | A(146) | B(1.1) |
| Example 3 | Magnetic Toner 3 | A(1) | A(1.53) | B(3) | A(1.51) | B(5) | A(1.48) | A(144) | C(1.6) |
| Example 4 | Magnetic Toner 4 | A(0) | A(1.53) | A(0) | A(1.51) | A(1) | A(1.49) | B(153) | A(0.6) |
| Example 5 | Magnetic Toner 5 | A(1) | A(1.46) | B(3) | B(1.44) | B(4) | C(1.34) | A(146) | A(0.4) |
| Example 6 | Magnetic Toner 6 | A(0) | A(1.52) | A(0) | A(1.50) | A(1) | A(1.48) | A(148) | A(0.7) |
| Example 7 | Magnetic Toner 7 | A(0) | A(1.50) | A(1) | A(1.48) | A(2) | B(1.44) | A(148) | A(0.6) |
| Example 8 | Magnetic Toner 8 | A(0) | A(1.52) | A(0) | A(1.50) | A(1) | A(1.48) | B(154) | A(0.5) |
| Example 9 | Magnetic Toner 9 | A(0) | A(1.51) | A(0) | A(1.50) | A(1) | A(1.48) | C(161) | A(0.5) |
| Example 10 | Magnetic Toner 10 | A(1) | B(1.41) | B(3) | C(1.34) | C(6) | C(1.26) | A(148) | A(0.3) |
| Example 11 | Magnetic Toner 11 | A(0) | A(1.50) | A(0) | A(1.47) | A(1) | B(1.40) | C(160) | A(0.8) |
| Example 12 | Magnetic Toner 12 | A(2) | A(1.47) | B(4) | B(1.38) | C(7) | C(1.32) | A(141) | A(0.4) |
| Example 13 | Magnetic Toner 13 | A(0) | A(1.52) | A(0) | A(1.51) | A(1) | A(1.49) | C(167) | A(0.5) |
| Example 14 | Magnetic Toner 14 | B(3) | B(1.44) | C(6) | C(1.34) | C(10) | C(1.25) | A(140) | A(0.5) |
| Example 15 | Magnetic Toner 15 | A(0) | A(1.52) | A(0) | A(1.51) | A(1) | A(1.49) | C(169) | A(0.5) |
| Comparative Example 1 | Comparative Magnetic Toner 1 | C(10) | B(1.41) | D(18) | D(1.23) | D(26) | D(1.20) | D(180) | D(2.1) |

TABLE 5-continued

| | | before holding, high temperature high humidity environment initial developing performance | | after holding, high temperature high humidity environment initial developing performance | | developing performance post-durability testing | | low-temperature fixability (° C.) | under a low temperature low humidity environment fogging |
|---|---|---|---|---|---|---|---|---|---|
| Example | Toner | dot reproducibility (number) | density | dot reproducibility (number) | density | dot reproducibility (number) | density | | |
| Comparative Example 2 | Comparative Magnetic Toner 2 | B(5) | B(1.43) | D(12) | B(1.39) | D(19) | D(1.18) | C(163) | B(1.5) |
| Comparative Example 3 | Comparative Magnetic Toner 3 | B(4) | B(1.40) | D(11) | D(1.24) | D(16) | D(1.23) | D(190) | D(2.2) |
| Comparative Example 4 | Comparative Magnetic Toner 4 | B(3) | B(1.41) | D(10) | C(1.30) | D(13) | D(1.24) | D(175) | D(2.6) |
| Comparative Example 5 | Comparative Magnetic Toner 5 | C(6) | B(1.40) | D(16) | C(1.26) | D(21) | D(1.16) | D(179) | D(2.9) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-186296, filed Aug. 23, 2010 which is hereby incorporated by reference herein in its entirety.

What is claimed is:

1. A magnetic toner comprising magnetic toner particles and an inorganic fine powder; each of the magnetic toner particles contains a binder resin, a magnetic body, and a release agent, wherein the magnetic body comprises magnetic iron oxide, and in a stress relaxation measurement using a rotating plate rheometer, the magnetic toner exhibits a yield value A at 25° C. of at least $3\times10^6$ (sec), and the magnetic toner that has been heated to 80° C. and then cooled to 25° C. exhibits a yield value B at 25° C. of not more than $1\times10^5$ (sec), wherein, with respect to a radius of gyration (Rw) and the weight-average molecular weight (Mw) of the tetrahydrofuran (THF)-soluble fraction of the magnetic toner as measured using size exclusion chromatography with a multiangle laser light scattering (SEC-MALLS), i) the weight-average molecular weight (Mw) is from 6,000 to 24,000, and ii) the weight-average molecular weight (Mw) and the radius of gyration (Rw) satisfy the following equation (1):

$$2.5\times10^3 \leq Rw/\mathrm{Mw} \leq 6.8\times10^{-3} \quad (1),$$

wherein the melting point of the release agent is from at least 50° C. to 83° C., wherein the magnetic body is a treated magnetic body that has been surface treated in use of a silane compound with the following general formula (A):

$$R_mSiY_n \quad (A)$$

where R represents an alkoxyl group, m represents an integer from at least 1 to not more than 3, Y represents an alkyl group, n represents an integer from at least 1 to not more than 3, and m+n=4, and wherein the binding resin has a branching structure provided by use of a polymerization initiator, the polymerization initiator being an azo-type, diazo-type, or peroxide-type polymerization initiator.

2. The magnetic toner according to claim 1, wherein the magnetic toner has a dielectric loss tangent (tan δ) at a frequency of $1.0\times10^4$ Hz of from at least $1.0\times10^{-2}$ to not more than $2.5\times10^{-2}$.

3. The magnetic toner according to claim 1, wherein the BET specific surface area (S1) of the magnetic body prior to the surface treatment and the BET specific surface area (S2) of the treated magnetic body satisfy the following equation (2):

$$S2/S1 \geq 0.70 \quad (2).$$

4. The magnetic toner according to claim 1, wherein the magnetic toner particle is produced in an aqueous medium.

5. The magnetic toner according to claim 4, wherein the magnetic toner particle is produced by a suspension polymerization method.

* * * * *